US006131644A

United States Patent [19]

Kohara et al.

[11] Patent Number: 6,131,644

[45] Date of Patent: Oct. 17, 2000

[54] HEAT EXCHANGER AND METHOD OF PRODUCING THE SAME

[75] Inventors: Kimio Kohara; Akito Torii, both of Nisshin, Japan

[73] Assignee: Advanced Mobile Telecommunication Technology Inc., Aichi, Japan

[21] Appl. No.: 09/281,261

[22] Filed: Mar. 30, 1999

[30] Foreign Application Priority Data

Mar. 31, 1998 [JP] Japan ..... 10-085475
Mar. 31, 1998 [JP] Japan ..... 10-085477

[51] Int. Cl.[7] ..... F28D 17/00

[52] U.S. Cl. ..... 165/10; 165/6; 165/4; 62/6

[58] Field of Search ..... 165/4, 6, 10; 62/6, 62/259.1, 259.3, 430

[56] References Cited

U.S. PATENT DOCUMENTS

| | | | |
|---|---|---|---|
| 3,216,484 | 11/1965 | Gifford | 165/4 |
| 3,692,095 | 9/1972 | Fleming | 165/4 |
| 3,692,099 | 9/1972 | Nesbit et al. | 62/6 |
| 3,960,204 | 6/1976 | Horn | 62/6 |
| 4,209,061 | 6/1980 | Schwemin | 165/10 |
| 4,259,844 | 4/1981 | Sarcia et al. | 62/6 |
| 4,357,987 | 11/1982 | Oda et al. | 165/10 |
| 4,478,046 | 10/1984 | Saito et al. | 62/6 |
| 4,612,912 | 9/1986 | Lampe | 126/400 |
| 4,830,092 | 5/1989 | Lee | 165/1 |
| 4,901,787 | 2/1990 | Zornes | 165/4 |
| 5,165,466 | 11/1992 | Arbabian | 165/4 |
| 5,286,345 | 2/1994 | Burt | 156/659 |
| 5,351,490 | 10/1994 | Ohishi et al. | 62/6 |
| 5,429,177 | 7/1995 | Yaron et al. | 165/10 |
| 5,469,709 | 11/1995 | Lee | 62/6 |
| 5,522,223 | 6/1996 | Yanai et al. | 62/6 |
| 5,746,269 | 5/1998 | Torii et al. | 165/10 |
| 5,920,133 | 7/1999 | Penswick et al. | 62/6 |

FOREIGN PATENT DOCUMENTS 08145485 of 1996 Japan ..... F25B 9/00

*Primary Examiner*—Ira S. Lazarus
*Assistant Examiner*—Terrell McKinnon
*Attorney, Agent, or Firm*—Richard L. Aitken; Venable

[57] ABSTRACT

A heat exchanger comprises a gas casing formed with a gas chamber filled with a refrigerant gas, and a heat exchanging unit received in the gas chamber of the gas casing. The heat exchanging unit has a plurality of regenerative plates each made of a material having a thermal conductivity and a heat capacity. The regenerative plates are positioned in face-to-face and thermally insulated relationships to one another with the surfaces being in substantially perpendicular to the center axis of the heat exchanging unit to define spaces each between the neighboring two regenerative plates. Each of the regenerative plates may be shaped in the symmetrical outline form with respect to its central point and smaller in size than the cross-sections of the gas chamber of the gas casing. Each of the regenerative plates has a plurality of airy holes formed therein. The airy holes of the regenerative plates and part of the spaces define in combination a plurality of inner gas flow passageways extending in substantially perpendicular relationship to the surfaces of the regenerative plates to allow the refrigerant gas to flow therethrough to effect a heat exchange between the regenerative plates and the refrigerant gas therethrough while the refrigerant gas is passing through the gas casing.

The heat exchanger can have the loss in the heat conductivity lessened to enhance the efficiency of exchanging the heat energy between the gas and the regenerator as well as can be manufactured by hand without laborious tasks.

4 Claims, 17 Drawing Sheets

HEAT EXCHANGER AND METHOD OF PRODUCING THE SAME

BACKGROUND OF THE INVENTION

1. Field of the Invention

The present invention relates to a heat exchanger and a method of producing the same, and more particularly to a heat exchanger for use in a cryogenic refrigerator, such as a reversed Stirling cycle refrigerator, a Gifford-MacMahon cycle refrigerator, a pulse tube refrigerator, and the like.

2. Description of the Related Art

One typical example of known heat exchangers comprises a regenerative matrix for allowing a gas to flow therethrough and having a heat conductivity, a heat capacity, and a wide contact surface held in contact with the gas, and is thus adapted to exchange heat energy between the regenerative matrix and the gas while the gas is passing through the regenerative matrix. The heat exchanger is generally utilized as a regenerator for a cryogenic refrigerator.

A typical cryogenic refrigerator of this type, for example, a pulse tube refrigerator, is shown in FIG. 32 as comprising a gas cylinder 1, a regenerator 2, a pulse tube 3, a reciprocating piston 4, an orifice valve 5, and a buffer tank 6.

The gas cylinder 1 is formed with a chamber having the reciprocating piston 4 movably received therein and divided into two spaces one of which defines a hermetical sealed gas chamber 1*a* having a center axis and a gas flow port opened to the regenerator 2. The regenerator 2 comprises a pair of heat exchanging portions 2*a* and 2*b* and a regenerative matrix portion 2*c* interposed between the pair of heat exchanging portions 2*a* and 2*b*. The heat exchanging portion 2*a* of the regenerator 2 is mechanically connected to the gas cylinder 1 through the gas flow port of the gas chamber 1*a* of the gas cylinder 1.

The pulse tube 3 is formed with a gas chamber 3*a* and has a first longitudinal end portion mechanically connected to the heat exchanging portion 2*b* of the regenerator 2, and a second longitudinal end portion opposite to the first longitudinal end portion and mechanically connected to the buffer tank 6 through the orifice valve 5. The gas chamber 1*a* of the gas cylinder 1, the regenerator 2, and the gas chamber 3*a* of the pulse tube 3 therefore collectively define a hermetically sealed closed system.

The gas chamber 1*a* of the gas cylinder 1, the gas chamber 3*a* of the pulse tube 3, and the buffer tank 6 are filled with a refrigerant gas. The regenerator 2 is formed with a plurality of gas flow passageways for allowing the refrigerant gas to flow between the gas cylinder 1 and the pulse tube 3 therethrough with a large gas contact area surface to be held in contact with the refrigerant gas. The regenerative matrix 2*c* of the regenerator 2 is adapted to exchange the heat energy with the contacted refrigerant gas.

The reciprocating piston 4 is reciprocated along with the center axis of the gas cylinder 1 to have the refrigerant gas in the gas chamber 1*a* of the gas cylinder 1 repeatedly compressed and expanded and to allow the compressed and expanded refrigerant gas to flow between the gas chamber 1*a* of the gas cylinder 1 and the gas chamber 3*a* of the pulse tube 3 through the gas flow passageways of the regenerator 2.

The buffer tank 6 is designed to cooperate with the orifice valve 5 to regulate a pressure in the gas chamber 3*a* of the pulse tube 3, thereby causing a pulsatory motion of compressed and expanded gas in the gas chamber 3*a* of the pulse tube 3.

The reciprocating motion of the reciprocating piston 4 and the pulsatory motion of gas flow are repeated at a predetermined cycle, but performed at different phases from each other while the refrigerator operates. The pulsatory motion of gas flow in the gas chamber 3*a* of the pulse tube 3 is phase shifted by one fourth of the cycle, i.e., a phase angle of 90 degrees with respect to the reciprocating motion of the reciprocating piston 4.

The refrigerator is repeatedly operated in accordance with the following four processes consisting an isothermal compression process, an isovolumetric heat radiating process, an isothermal expansion process, and an isovolumetric heat absorbing process.

In the isothermal compression process, the refrigerant gas is compressed in the gas chamber 1*a* of the gas cylinder 1, and the heat energy is transferred from the refrigerant gas to the heat exchanging portion 2*a* of the regenerator 2. Accordingly, the heat exchanging portion 2*a* of the regenerator 2 is heated while the refrigerant gas is cooled.

In the isovolumetric heat radiating process, the heat energy is radiated from the heat exchanging portion 2*a* of the regenerator 2 to the outside of the refrigerator 2. The cooled refrigerant gas flows from the gas chamber 1*a* of the gas cylinder 1 to the gas chamber 3*a* of the pulse tube 3 through the regenerator 2. The regenerative matrix 2*c* of the regenerator 2 is operated to exchange the heat energy with the refrigerant gas, when the refrigerant gas is transferred between the gas chamber 3*a* of the pulse tube 3 and the gas chamber 1*a* of the gas cylinder 1 through the regenerator 2. In this case, the heat energy is transferred from the regenerator 2 to the refrigerant gas.

In the isothermal expansion process, the refrigerant gas is expanded in the gas chamber 3*a* of the pulse tube 3, and the heat energy is transferred from the heat exchanging portion 2*b* of the regenerator 2 to the refrigerant gas. Accordingly, the heat exchanging portion 2*b* of the regenerator 2 is cooled while the refrigerant gas in the gas chamber 3*a* of the pulse tube 3 is heated.

In the isovolumetric heat absorbing process, the heated refrigerator gas flows from the gas chamber 3*a* of the pulse tube 3 to the gas chamber 1*a* of the gas cylinder 1 through the regenerator 2. The heat energy is transferred from the regenerator 2 to the refrigerant gas. The refrigerator repeatedly performs the aforesaid processes.

A conventional regenerator constituting the heat exchanger of the above type is shown in detail in FIG. 33. The regenerator of the heat exchanger comprises a cylindrical casing 7 and a plurality of regenerative plates 8. The cylindrical casing 7 is formed with a chamber 7*a* having an opened end.

Each of the regenerative plates 8 is produced by modeling a mesh plate after a predetermined pattern. As a result, the regenerative plates 8 thus constructed have a tendency to be irregular in size and shape, thereby causing the heat exchanger to be irregular in relationship between the neighboring two regenerative plates 8 in the cylindrical casing 7. For this reason, it is difficult for the heat exchanger to obtain a desired efficiency of heat exchanging between the regenerative plates 8 and the gas.

In the process of producing the heat exchanger, the regenerative plates 8 are inserted into the cylindrical casing 7 through the opened end of the chamber 7*a* of the cylindrical casing 7 one by one by hand to form into a regenerative heat exchanging unit 9 including thousands of regenerative plates 8. Therefore, the heat exchanging unit 9 is produced to be laborious in work and management of the large number of regenerative plates 8, thereby taking much time of manufacturing process and bringing a high cost.

The heat exchanger of another type is disclosed in U.S. Pat. No. 5,746,269, filed Aug. 13, 1993 and assigned to the assignee of the present invention in which each of the regenerative plates is made of a thin metal plate formed with a plurality of holes by etching. This type of heat exchanger has an advantage in a flexible design of the regenerative plates as well as making the regenerative plates uniform in size and shape. As a result, the heat exchanger can effectively exchange the heat energy between the regenerative plates and the gas. However, this type of heat exchanger has still a drawback to be encountered in that the heat exchanger comprises a large number of regenerative plates inserted in the gas casing one by one by hand, thereby taking much time of manufacturing process and bringing a high cost.

In the aforesaid heat exchanger, the neighboring two regenerative plates 8 are held in directly contact with one another so that the regenerative plates 8 in the heat exchanger define as a whole a heat transmission path in parallel relationship with the gas flow passageways. In consequence, the heat exchanger further has a drawback to be encountered in that the heat energy is liable to transfer between the neighboring two regenerative plates 8, thereby causing a loss in the heat conductivity.

SUMMARY OF THE INVENTION

It is therefore an object of the present invention to provide a heat exchanger which can have the loss in the heat conductivity lessened to enhance the efficiency of exchanging the heat energy between the gas and the regenerator.

It is another object of the present invention to provide a heat exchanger which can be manufactured by hand without laborious tasks.

It is a further object of the present invention to provide a heat exchanger which can regulate the efficiency of exchanging the heat energy between the gas and the regenerator.

In accordance with a first aspect of the present invention, there is provided a heat exchanger comprising a hermetically sealed gas casing formed with a gas chamber filled with a refrigerant gas and having a center axis. The gas casing has longitudinal end portions along the center axis and is formed with first and second ports having the refrigerant gas passing therethrough. The heat exchanger further comprises a plurality of heat exchanging units each having a center axis and received in the gas chamber of the gas casing with the center axes thereof being in coaxial relationship with the center axis of the gas casing. Each of the heat exchanging units has a plurality of regenerative plates each having a thickness to have a first flat surface and a second flat surface opposite to the first flat surface, and positioned in face-to-face and thermally insulated relationships to one another with the first and second flat surfaces being in substantially perpendicular to the center axis of the heat exchanging unit. The heat exchanger further comprises connecting means for mechanically and partially connecting and retaining the plurality of regenerative plates in face-to-face and thermally insulated relationships to one another to define spaces each between the neighboring two regenerative plates. Each of regenerative plates is made of a material having a thermal conductivity and a heat capacity. Each of the regenerative plates has a plurality of airy holes formed therein. The airy holes of the regenerative plates and part of the spaces in the heat exchanging units define in combination a plurality of inner gas flow passageways extending in substantially perpendicular relationship to the first and second flat surfaces of the regenerative plates to allow the refrigerant gas to flow therethrough to effect a heat exchange between the regenerative plates and the refrigerant gas therethrough while the refrigerant gas is passing through the first and second ports of the gas casing.

In the aforesaid heat exchanger, each of the regenerative plates may have a circumferential border portion. The circumferential border portions of the regenerative plates collectively define an outside portion of the heat exchanging unit. The regenerative plates are partially secured to one another at the outside portion of the heat exchanging unit by the connecting means.

The circumferential portion of the regenerative plates may be formed with a plurality of concave portions. The concave portions of the regenerative plates and part of the spaces in the heat exchanging unit define in combination a plurality of grooves extending on the outside surface of the heat exchanging unit in substantially parallel relationship with the center axis of the heat exchanging unit. The connecting means is fitted into each of the grooves of the heat exchanging unit to have the regenerative plates partially connected to one another at the concave portions around its circumferential portion.

Each of the regenerative plates may have a central portion formed with a central hole larger in size than the airy holes. The central holes of the regenerative plates and part of the spaces in the heat exchanging units define in combination a center longitudinal through bore extending into the heat exchanging unit. The connecting means is shaped in the form of rod piercing through the center longitudinal through bore to partially connect the regenerative plates to one another.

In accordance with a second aspect of the present invention, there is provided a method of producing a heat exchanger comprising a hermetically sealed gas casing formed with a gas chamber filled with a refrigerant gas and having a center axis, and a plurality of heat exchanging units. The gas casing has longitudinal end portions along the center axis and being formed with first and second ports having the refrigerant gas passing therethrough.

The heat exchanger producing method comprises the step of (a) preparing a plurality of regenerative plates each having a thickness to have a first flat surface and a second flat surface opposite to the first flat surface, and a plurality of temporary layers each made of a releasable material and each having a thickness. Each of regenerative plates is made of a material having a thermal conductivity and a heat capacity. Each of the regenerative plates has a plurality of airy holes formed therein.

The heat exchanger producing method further comprises the steps of: (b) situating the regenerative plates and the temporary layers by turn in face-to-face relationship with one another to form a stack of the regenerative plates so that each of the temporary layers intervenes between the neighboring two regenerative plates;

(c) mechanically and partially connecting the regenerative plates in the stack with one another to form a provisional unit in which the regenerative plates and the temporary layers are retained in face-to-face relationship with one another;

(d) removing the temporary layers from the provisional unit of the regenerative plates to form a heat exchanging unit having a center axis and spaces each between the neighboring two regenerative plates; and (e) situating a plurality of the heat exchanging units in the gas chamber of the gas casing with the center axes thereof being in coaxial relationship with the center axis of the gas casing to have the first and second flat surfaces being in substantially perpendicular to the center axis of the heat exchanging unit. The airy holes of the regenerative plates and part of the spaces in the heat exchanging units define in combination a plurality of inner gas flow passageways extending in substantially perpendicular relationship to the first and second flat surfaces of the regenerative plates to allow the refrigerant gas to flow therethrough to effect a heat exchange between the regenerative plates and the refrigerant gas therethrough while the refrigerant gas is passing through the first and second ports of the gas casing.

In accordance with a third aspect of the present invention, there is provided a method of producing a heat exchanger comprising: a hermetically sealed gas casing formed with a gas chamber filled with a refrigerant gas and having a center axis; and a plurality of heat exchanging units. The gas casing has longitudinal end portions along the center axis and is formed with first and second ports having the refrigerant gas passing therethrough. The heat exchanger producing method comprises the step of (a) preparing a plurality of regenerative plates each having a thickness to have a first flat surface and a second flat surface opposite to the first flat surface and each made of a material having a thermal conductivity and a heat capacity. Each of the regenerative plates has a plurality of airy holes formed therein.

The heat exchanger producing method comprises the steps of:

(b) depositing a releasable material on at least one of the first and second flat surfaces of each of the regenerative plates to form a temporary layer having a thickness;

(c) situating the regenerative plates with the temporary layer in face-to-face relationship to one another to form a stack of the regenerative plates so that each of the temporary layers intervenes between the neighboring two regenerative plates;

(d) mechanically and partially connecting the regenerative plates in the stack with one another to form a provisional unit in which the plurality of regenerative plates are retained in face-to-face relationships to one another;

(e) removing the temporary layers from the provisional unit of the regenerative plates to form a heat exchanging unit having a center axis and spaces each between the neighboring two regenerative plates; and (f) situating a plurality of the heat exchanging units in the gas chamber of the gas casing with the center axes thereof being in coaxial relationship with the center axis of the gas casing to have the first and second flat surfaces being in substantially perpendicular to the center axis of the heat exchanging unit. The airy holes of the regenerative plates and part of the spaces in the heat exchanging units define in combination a plurality of inner gas flow passageways extending in substantially perpendicular relationship to the first and second flat surfaces of the regenerative plates to allow the refrigerant gas to flow therethrough to effect a heat exchange between the regenerative plates and the refrigerant gas therethrough while the refrigerant gas is passing through the first and second ports of the gas casing.

In the aforesaid method, the plate preparing step (a) has the step of (a1) preparing a plurality of thin plates each having a thickness to have a first surface and a second surface opposite to the first surface. The depositing step (b) has the steps of:

(b1) depositing a photosensitive resist material on one of first and second surface of the thin plates to pattern each of the thin plates with a predetermined porous pattern to form the temporary layer; and (b2) exposing the resist deposited thin plates to the light to etch and perforate the thin plates in accordance with the porous pattern to form the regenerative plates each having a plurality of airy holes and the temporary layer.

In accordance with a fourth aspect of the present invention, there is provided a method of producing a heat exchanger comprising: a hermetically sealed gas casing formed with a gas chamber filled with a refrigerant gas and having a center axis; and a plurality of heat exchanging units. The gas casing has longitudinal end portions along the center axis and being formed with first and second ports having the refrigerant gas passing therethrough. The heat exchanger producing method comprises the step of (a) preparing a plurality of regenerative plates each having a thickness to have a first flat surface and a second flat surface opposite to the first flat surface and each made of a material having a thermal conductivity and a heat capacity. Each of the regenerative plates has a plurality of airy holes formed therein.

The heat exchanger producing method further comprises the steps of:

(b) preparing a plurality of temporary plates each made of a releasable material and having a thickness and an outline substantially smaller in size than that of the regenerative plate;

(c) situating said regenerative plates and the temporary plates by turn in face-to-face relationship with one another to form a stack of the regenerative plates so that each of the temporary plates is interposed between the neighboring two regenerative plates;

(d) mechanically and partially connecting the regenerative plates in the stack with one another to form a provisional unit in which the regenerative plates and the temporary plates are retained in face-to-face relationship to one another;

(d) removing the temporary plates from the provisional unit of the regenerative plates to form a heat exchanging unit having a center axis and spaces each between the neighboring two regenerative plates; and (e) situating a plurality of the heat exchanging units in the gas chamber of the gas casing with the center axes thereof being in coaxial relationship with the center axis of the gas casing to have the first and second flat surfaces being in substantially perpendicular to the center axis of the heat exchanging unit. The airy holes of the regenerative plates and part of the spaces in the heat exchanging units define in combination a plurality of inner gas flow passageways extending in substantially perpendicular relationship to the first and second flat surfaces of the regenerative plates to allow the refrigerant gas to flow therethrough to effect a heat exchange between the regenerative plates and the refrigerant gas therethrough while the refrigerant gas is passing through the first and second ports of the gas casing.

In the aforesaid method, the gas chamber of the gas casing of the heat exchanger having cross-sections taken along planes substantially perpendicular to the center axis thereof and uniform in size and shape with each other. The plate preparing step (a) has the steps of:

(a1) preparing a plurality of thin plates each having a thickness to have a first surface and a second surface opposite to the first surface;

(a2) depositing a photosensitive resist material on one of first and second surface of the thin plates to pattern each of the thin plates the thin plate with a predetermined porous pattern; and (a3) exposing the resist deposited thin plates to the light to etch and perforate the thin plates in accordance with the porous pattern to form the regenerative plates each having a plurality of airy holes.

In accordance with a fifth aspect of the present invention, there is provided a regenerative heat exchanger comprising a hermetically sealed gas casing formed with a gas chamber filled with a refrigerant gas and having a center axis, the gas casing having longitudinal end portions along the center axis and formed with first and second ports having the refrigerant gas passing therethrough. The gas chamber of the gas casing has cross-sections taken along planes substantially perpendicular to the center axis thereof. The cross-sections of the gas chamber of the gas casing are uniform in size and shape with each other. The regenerative heat exchanger further comprises a heat exchanging unit having a center axis and a plurality of regenerative plates each having a thickness to have a first flat surface and a second flat surface opposite to the first flat surface. The regenerative plates are situated in face-to-face relationships with one another to have the first and second flat surfaces substantially perpendicular to the center axis of the heat exchanging unit. The heat exchanging unit is received in the gas chamber of the gas casing with the center axis thereof being in coaxial relationship with the center axis of the gas casing. Each of the regenerative plates is made of a material having a thermal conductivity and a heat capacity. Each of the regenerative plates has a central point and being shaped in the symmetrical outline form with respect to the central point and smaller in size than the cross-sections of the gas chamber of the gas casing. Each of the regenerative plates has a plurality of circumferential rib portions each having a width and circumferentially extending along the outline of the regenerative plate. The circumferential rib portions are arranged in concentric relationship with respect to the central point of the regenerative plate and radially spaced apart from one another. Each of the regenerative plates has a plurality of radial rib portions each having a width narrower than that of each of the circumferential rib portions and radially extending from the central point thereof and angularly spaced apart from one another. The circumferential rib portions and the radial rib portions define as a whole a plurality of slits radially outwardly of the central point of the regenerative plates and radially and circumferentially spaced apart from one another. The plurality of slits of the regenerative plates define a plurality of inner gas flow passageways in the heat exchanging unit in substantially perpendicular relationship to the first and second flat surfaces of the regenerative plates to allow the refrigerant gas to flow therethrough to effect a heat exchange between the regenerative plates and the refrigerant gas therethrough while the refrigerant gas is passing through the first and second ports of the gas casing.

The heat exchanging unit may include first and second groups of the regenerative plates. The circumferential rib portions of the first group of the regenerative plates are arranged at the position of the slits of the second group of the regenerative plates. The circumferential rib portions of the second group of the regenerative plates are arranged at the position of the slits of the first group of the regenerative plates, so that the slits of the first group of regenerative plates overlap with the slits of the second group of regenerative plates to have the gas flow passageways meander in the heat exchanging unit when the first and second groups of regenerative plates are situated by turn in the gas chamber of the gas casing.

Each of the regenerative plates of the first group may have a central portion different in shape from that of each of the regenerative plates of the second group. One of the central portions of the first and second regenerative plates may have a through bore.

In accordance with a sixth aspect of the present invention, there is provided a regenerative heat exchanger comprising a hermetically sealed gas casing formed with a gas chamber filled with a refrigerant gas and having a center axis. The gas casing has longitudinal end portions along the center axis and formed with first and second ports having the refrigerant gas passing therethrough. The gas chamber of the gas casing has cross-sections taken along planes substantially perpendicular to the center axis thereof and uniform in size and shape with each other. The regenerative heat exchanger further comprises a heat exchanging unit having a center axis and a plurality of regenerative plates each having a thickness to have a first flat surface and a second flat surface opposite to the first flat surface. The regenerative plates are situated in face-to-face relationships with one another to have the first and second flat surfaces substantially perpendicular to the center axis of the heat exchanging unit. The heat exchanging unit is received in the gas chamber of the gas casing with the center axis thereof being in coaxial relationship with the center axis of the gas casing. Each of the regenerative plates is made of a material having a thermal conductivity and a heat capacity. Each of the regenerative plates has a central point and being shaped in the symmetrical outline form with respect to the central point and smaller in size than the cross-sections of the gas chamber of the gas casing. Each of the regenerative plates has a plurality of circumferential rib portions each having a width and circumferentially extending along the outline of the regenerative plate. The circumferential rib portions are arranged in concentric relationship with respect to the central point of the regenerative plate and radially spaced apart from one another. Each of the regenerative plates has a plurality of radial rib portions each having a width narrower than that of each of the circumferential rib portions and radially extending from the central point thereof and angularly spaced apart from one another. The circumferential rib portions and the radial rib portions define as a whole a plurality of slits radially outwardly of the central point of the regenerative plates and radially and circumferentially spaced apart from one another. The regenerative heat exchanger further comprises a plurality of spacers each intervening between the regenerative plates to have the regenerative plates situated in face-to-face and thermally insulated relationships with one another in the gas chamber of the gas casing to define spaces each between the neighboring two regenerative plates. The plurality of slits of the regenerative plates and part of the spaces in the heat exchanging units define in combination a plurality of inner gas flow passageways in the heat exchanging unit in substantially perpendicular relationship to the first and second flat surfaces of the regenerative plates to allow the refrigerant gas to flow therethrough to effect a heat exchange between the regenerative plates and the refrigerant gas therethrough while the refrigerant gas is passing through the first and second ports of the gas casing.

In the aforesaid regenerative heat exchanger, the heat exchanging unit may include first and second groups of the regenerative plates. The circumferential rib portions of the first group of the regenerative plates are arranged at the position of the slits of the second group of the regenerative plates. The circumferential rib portions of the second group of the regenerative plates are arranged at the position of the slits of the first group of the regenerative plates, so that the slits of the first group of regenerative plates overlap with the slits of the second group of regenerative plates to have the gas flow passageways meander in the heat exchanging unit when the first and second groups of regenerative plates are situated by turn in the gas chamber of the gas casing.

Each of the regenerative plates of the first group may have a central portion different in shape from that of each of the regenerative plates of the second group. One of the central portions of the first and second regenerative plates may have a through bore.

BRIEF DESCRIPTION OF THE DRAWINGS

The present invention and many of the advantages thereof will be better understood from the following detailed description when considered in connection with the accompanying drawings, wherein.

DESCRIPTION OF THE PREFERRED EMBODIMENTS

Figure 1:
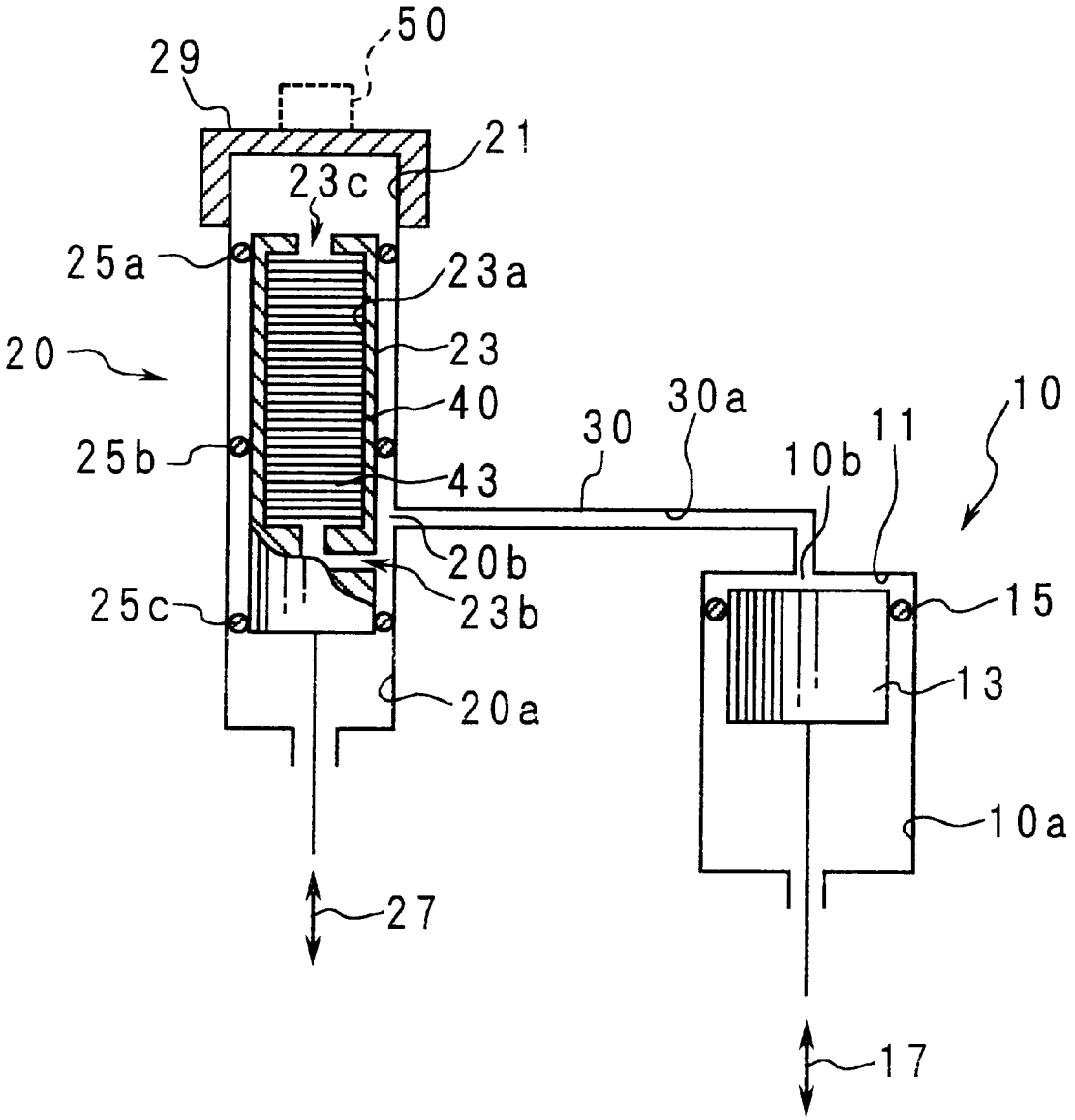
FIG. 1 is a schematic fragmental sectional view of a reversed Stirling cycle refrigerator utilizing a heat exchanger according to the present invention.

Throughout the following detailed description, similar reference characters refer to similar elements in all figures of the drawings.

Referring now to FIG. 1 of the drawings, there is shown a heat exchanger according to the present invention adaptable for use in a cryogenic refrigerator, such as a reversed Stirling cycle refrigerator.

The refrigerator comprises first and second cylindrical units 10 and 20, and a gas flow conduit 30 formed with a gas flow passageway 30*a*. The first and second cylindrical units 10 and 20 are mechanically connected with each other through the gas flow conduit 30. The first cylindrical unit 10 is formed with a closed chamber 10*a* filled with a refrigerant gas and has a gas flow port 10*b* opened to the gas flow passageway 30*a* of the gas flow conduit 30. The second cylindrical unit 20 is formed with a closed chamber 20*a* filled with a refrigerant gas and has a gas flow port 20*a* opened to the gas flow passageway 30*a* of the gas flow conduit 30. The closed chamber 10*a* of the first cylindrical unit 10 and the closed chamber 20*a* of the second cylindrical unit 20 are communicated with each other through the gas flow passageway 30*a* of the gas flow conduit 30, so that the refrigerant gas can be transferred between the closed chamber 10*a* of the first cylindrical unit 10 and the closed chamber 20*a* of the second cylindrical unit 20 through the gas flow passageway 30*a* of the gas flow conduit 30. The refrigerant gas is a cooling medium such as a helium, hydrogen or nitrogen.

The first cylindrical unit 10 comprises a compression piston 13 movably received by way of a ring-shaped sealed member 15 in the closed chamber 10*a* with its center axis being in coaxial relationship with the center axis of the closed chamber 10*a* so as to divide the closed chamber 10*a* into two spaces consisting a first space to which the gas flow port 10*b* of the first cylindrical unit 10 is opened, and a second space opposite to the first space through the compression piston 13. The first space of the closed chamber 10*a* of the first cylindrical unit 10 defines a compression chamber 11.

The compression piston 13 is operated to reciprocate along the center axis of the closed chamber 10*a* of the first cylindrical unit 10 in the directions shown by a double headed arrow 17 to assume three different positions consisting of a top dead point position where the compression chamber 11 of the first cylindrical unit 10 has the smallest volume, a bottom dead point position where the compression chamber 11 of the first cylindrical unit 10 has the largest volume, and an intermediate point position situated between the top dead point position and the bottom dead point position.

The second cylindrical unit 20 comprises an expansion piston 23 movably received by way of three of ring-shaped sealed members 25*a*, 25*b* and 25*c* in the closed chamber 20*a* with its center axis being in coaxial relationship with the center axis of the closed chamber 20*a* so as to divide the closed chamber 20*a* into two spaces consisting a first space and a second space opposite to the first space through the expansion piston 23. The first space of the closed chamber 20*a* of the second cylindrical unit 20 defines an expansion chamber 21.

The expansion piston 23 is formed with a gas chamber 23*a* and has a center axis being in coaxial relationship with the center axis of the closed chamber 20*a* of the second cylindrical unit 20. The expansion piston 23 has longitudinal end portions along the center axis and is formed with first and second ports 23*b* and 23*c* through which the refrigerant gas is introduced into and discharged from the gas chamber 23*a* of the expansion piston 23. The first ports 23*b* of the expansion piston 23 is opened to the gas flow port 20*b* of the second cylindrical unit 20 while the second ports 23*c* of the expansion piston 23 is opened to the expansion chamber 21 of the second cylindrical unit 20.

The expansion chamber 21 of the second cylindrical unit 20, the gas chamber 23*a* of the expansion piston 23, the gas flow passageway 30*a* of the gas flow conduit 30, and the compression chamber 11 of the first cylindrical unit 10 integrally define a gas flow channel to allow the refrigerant gas to flow therethrough in the refrigerator.

The expansion piston 23 is operated to reciprocate along the center axis of the closed chamber 20*a* of the second cylindrical unit 20 in the directions shown by a double headed arrow 27 to assume three different positions consisting of a top dead point position where the expansion chamber 21 of the second cylindrical unit 20 has the smallest volume, a bottom dead point position where the expansion chamber 21 of the second cylindrical unit 20 is the largest volume, and an intermediate point position situated between the top dead point position and the bottom dead point position.

The second cylindrical unit 20 further comprises a cooling unit 29 having a cooling stage made of a material having a heat capacity and a heat conductivity and placed at the side of the expansion chamber 21 thereof. The cooling stage of the cooling unit 29 has a contact surface for contacting a cooled target 50 to be cooled by the refrigerator.

The refrigerator further comprises a regenerative heat exchanging unit 40 having a center axis and received in the gas chamber 23*a* of the expansion piston 23 with the center axis thereof being coaxial relationship with the center axis of the gas chamber 23*a* of the expansion piston 23.

The regenerative heat exchanging unit 40 comprises a regenerative matrix including a plurality of regenerative plates 43, for example, thousands of plates. Each of the regenerative plates 43 has a thickness to have a first flat surface and a second flat surface opposite to the first flat surface. In the heat exchanging unit 40, the regenerative plates 43 are positioned in face-to-face and thermally insulated relationships to one another with the first and second flat surfaces being in substantially perpendicular to the center axis of the heat exchanging unit 40 to define spaces each between the neighboring two regenerative plates 43. Each of regenerative plates 43 is made of a material having a thermal conductivity and a heat capacity. Each of the regenerative plates 43 has a plurality of airy holes formed therein. The airy holes of the regenerative plates 43 and part of the spaces in the heat exchanging units 43 define in combination a plurality of inner gas flow passageways extending in substantially perpendicular relationship to the first and second flat surfaces of the regenerative plates 43 to allow the refrigerant gas to flow therethrough to effect a heat exchange between the regenerative plates 43 and the refrigerant gas therethrough while the refrigerant gas is passing through the gas chamber 23*a* of the expansion piston 23.

The regenerative heat exchanging unit 40 thus constructed can increase a gas contact area surface of the regenerative plates 43 which can be held into contact with the refrigerant gas, thereby efficiently performing the heat exchange between the regenerative plates 43 and the refrigerant gas.

In the refrigerator, the reciprocating motion of the compression piston 13 of the first cylindrical unit 10 and the reciprocating motion of the expansion piston 23 of the second cylindrical unit 20 are repeated at a predetermined cycle, but performed at different phases from each other. The reciprocating motion of the compression piston 13 of the first cylindrical unit 10 is phase shifted by one fourth of the reciprocating cycle, i.e., a phase angle of 90 degrees with respect to the expansion piston 23 of the second cylindrical unit 20.

The phase difference in the reciprocating motions causes a phase difference in a variation in pressure of the refrigerant gas to be compressed and expanded. As a result, the regenerative plates 43 of the heat exchanging unit 40 can efficiently exchange the heat energy with the refrigerant gas in accordance with the variation in pressure of the refrigerant gas. The heat exchange between the regenerative plates 43 of the heat exchanging unit 40 and the refrigerant gas is performed to have the refrigerant gas in the expansion chamber 21 of the second cylindrical unit 20 cooled while the heat energy is radiated from the conduit 30 to the outside of the refrigerator.

When the refrigerator gas in the expansion chamber 21 of the second cylindrical unit 20 is cooled to have a temperature relatively lower than that of the cooling unit 29, the heat energy is transferred from the cooling unit 29 to the refrigerant gas. As a result, the cooling unit 29 of the refrigerator is cooled by the refrigerant gas in the expansion chamber 21 of the second cylindrical unit 20. Therefore, the cooling unit 29 of the refrigerator can cool the cooled target 50.

Referring to FIGS. 2 to 7 of the drawings, there is shown a first embodiment of the heat exchanger according to the present invention. The first embodiment of the heat exchanger constitutes the aforesaid reversed Stirling cycle refrigerator shown in FIG. 1. In the first embodiment, the heat exchanging unit 40 of the refrigerator shown in FIG. 1 is constituted by a plurality of heat exchanging units 130 shown in FIG. 2.

Figure 2:
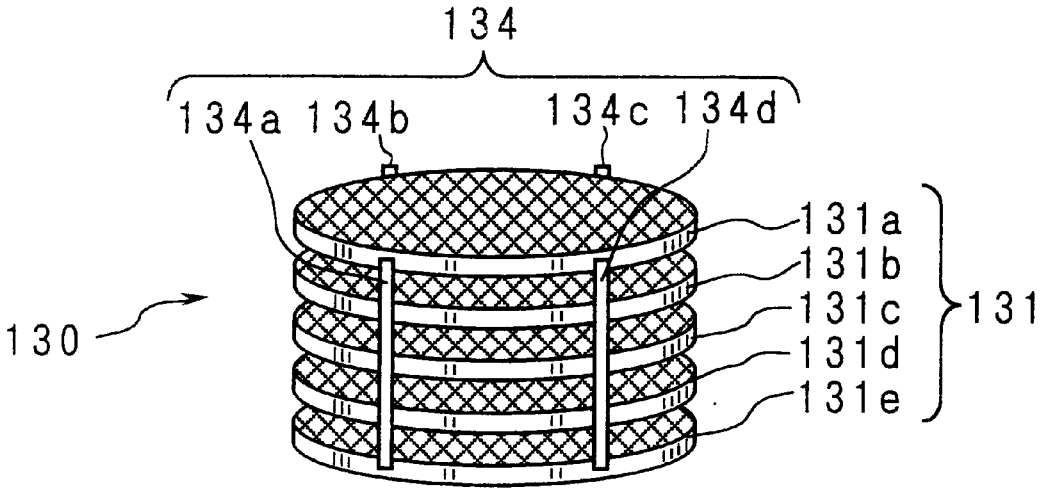
FIG. 2 is a perspective view of a regenerative heat exchanging unit of a first embodiment of the heat exchanger according to the present invention.

Each of the heat exchanging units 130 comprises a plurality of regenerative plates 131 and a plurality of connecting parts 134 as shown in FIG. 2. The regenerative plates 131 include, but not limited to, five plates 131*a*, 131*b*, 131*c*, 131*d* and 131*e*. In practice, the heat exchanging unit 130 includes hundreds or thousands of regenerative plates 131. The connecting parts 134 include, but not limited to, four connecting parts 134*a*, 134*b*, 134*c* and 134*d*.

Each of the regenerative plates 131 has a thickness of 60–100 $\mu$m to have a first flat surface and a second flat surface opposite to the first flat surface. The regenerative plates 131 are positioned in face-to-face and thermally insulated relationships to one another with the first and second flat surfaces being in substantially perpendicular to the center axis of the heat exchanging unit 130.

The connecting parts 134 are adapted to mechanically and partially connect and retain the plurality of regenerative plates 131 in face-to-face and thermally insulated relationships to one another to define spaces each between the neighboring two regenerative plates 131.

Figure 3:
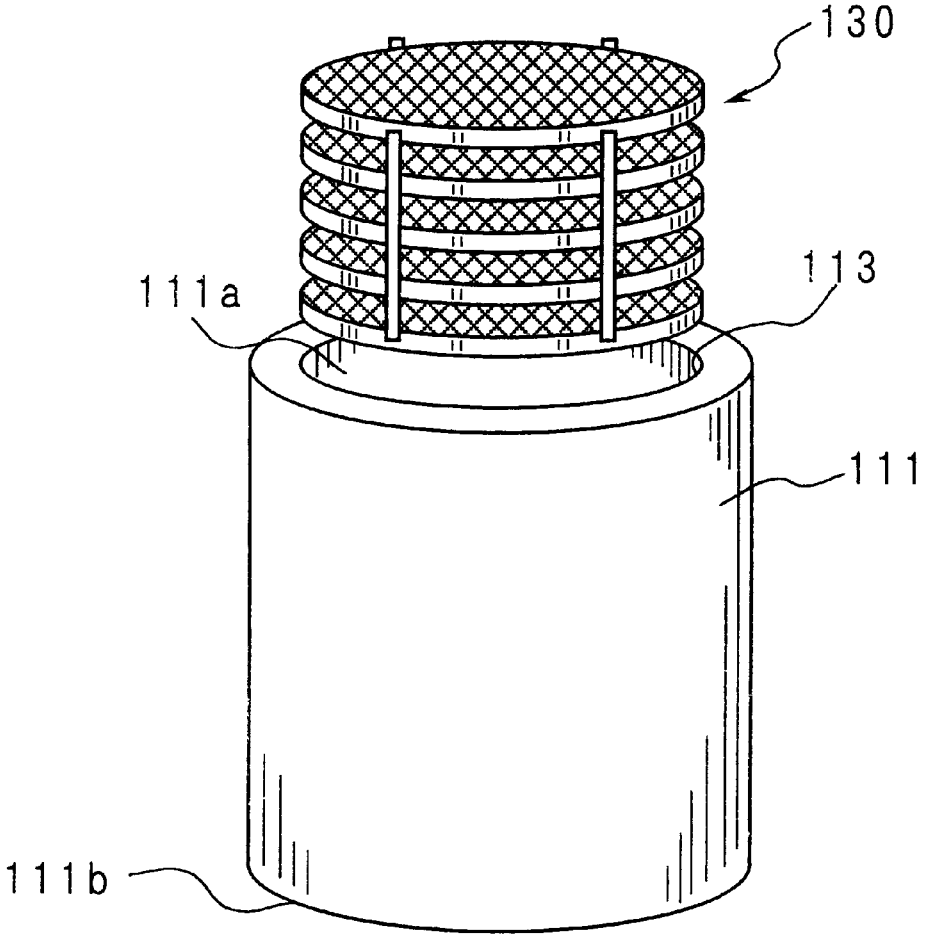
FIG. 3 is a perspective view of the regenerative heat exchanging unit shown in FIG. 2 but prior to being inserted into the gas casing.

As shown in FIG. 3, the heat exchanger according to the present invention comprises a hermetically sealed gas casing 111 formed with a gas chamber 113 filled with a refrigerant gas and having a center axis. The gas casing 111 has longitudinal end portions along the center axis and is formed with first and second ports 111*a* and 111*b* to allow the refrigerant gas to pass therethrough. The heat exchanger further comprises a plurality of the above heat exchanging units 130 each having a center axis and received in the gas chamber 113 of the gas casing 111 with the center axes thereof being in coaxial relationship with the center axis of the gas casing 111. The gas chamber 113 of the gas casing 111 has cross-sections taken along planes substantially perpendicular to the center axis thereof and uniform in size and shape with each other. The regenerative plates 131 are smaller in size than the cross-sections of the gas chamber 113 of the gas casing 111, so as to be snugly received in the gas chamber 113 of the gas casing 111.

Each of regenerative plates 131 is made of a material having a thermal conductivity and a heat capacity. Each of the regenerative plates 131 has a plurality of airy holes formed therein. The airy holes of the regenerative plates 131 and part of the spaces in the heat exchanging unit 130 define in combination a plurality of inner gas flow passageways extending in substantially perpendicular relationship to the first and second flat surfaces of the regenerative plates 131 to allow the refrigerant gas to flow therethrough to effect a heat exchange between the regenerative plates 131 and the refrigerant gas therethrough while the refrigerant gas is passing between the first and second ports 111*a* and 111*b* of the gas casing 111 through the gas chamber 113 of the gas casing 111.

In this embodiment, the space between the neighboring two regenerative plates 131 of the heat exchanging unit 130 has a distance adjusted so as to have the heat exchanging unit 130 efficiently perform the heat exchange between the regenerative plates 131 and the refrigerant gas. The heat exchanger can thus obtain a desired efficiency of heat exchanging between the regenerative plates 131 and the refrigerant gas in accordance with the distance of the space between the neighboring two regenerative plates 131 of the heat exchanging unit 130.

The distance of the space between the neighboring two regenerative plates 131 of the heat exchanging unit 130 may be preferably 10 $\mu$m or less. The distance preferably decreases as smaller as possible, thereby increasing the number of the regenerative plates 131 of the heat exchanging unit 130 contained in the gas chamber 113 of the gas casing 111. The heat exchanger can enhance the efficiency of the heat exchange between the regenerative plates 131 of the heat exchanging unit 130 and the refrigerant gas, because of the fact that the heat energy is prevented from transferring between the neighboring two regenerative plates 131 in the heat exchanging unit 130.

In order to produce the heat exchanger having thousands of regenerative plates 131 contained in the gas chamber 113 of the gas casing 111, for example, a several exchanging units 130 including hundreds of regenerative plates 131 can be inserted into the gas chamber 113 of the gas casing 111. This results in the fact that a lot of trouble can be saved in comparison with thousands of regenerative plates 131 inserted one by one by hand into the gas chamber 113 of the gas casing 111.

The method of producing the first embodiment of the heat exchanging unit 130 shown in FIG. 2 will be described hereinlater with reference to FIGS. 4 to 7 of the drawings.

The method of producing the heat exchanging unit 130 comprises the step of (a) preparing a plurality of regenerative plates 131. Each of the regenerative plates 131 is made of a material having a thermal conductivity and a heat capacity. Each of the regenerative plates 131 has a plurality of airy holes formed therein. Each of the regenerative plates 131 has a thickness to have a first flat surface and a second flat surface opposite to the first flat surface.

Figure 4:
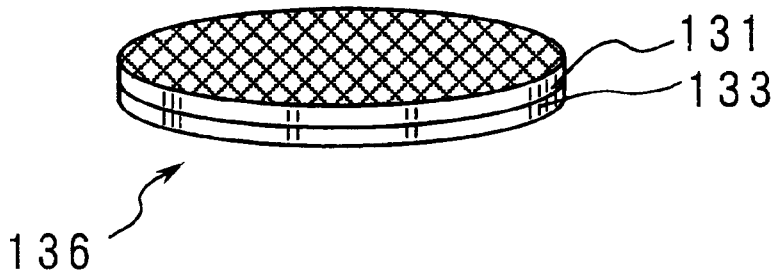
FIGS. 4 to 7 are perspective views collectively illustrating the processes of producing the regenerative heat exchanging unit shown in FIG. 2.

The method of producing the heat exchanging unit 130 further comprises the step of (b) depositing a releasable material on at least one of the first and second flat surfaces of each of the regenerative plates 131 to form a temporary layer 133 as shown in FIG. 4.

In the steps (a) and (b), each of the regenerative plates 131 may be made of a mesh screen having a thickness of 60–100 $\mu$m. The mesh screen is smaller in size than the cross-sections of the gas chamber 113 of the gas casing 111, so that the regenerative plates 131 can be snugly received in the gas chamber 113 of the gas casing 111. In this embodiment, the gas chamber 113 of the gas casing has a cylindrical form having a predetermined inner diameter. Each of the regenerative plates 131 is therefore shaped in the disc form having an outer diameter smaller than the inner diameter of the gas chamber 113 of the gas casing 111 as shown in FIG. 4.

The mesh screen may be shaped into the disc shape before each of the regenerative plates 131 is coated with a releasable material to form a temporary layer 133 on one of the first and second flat surfaces. Alternatively, the mesh screen may be coated with a releasable material before each of the regenerative plates 131 is shaped into the disc form. In other words, the regenerative plates 131 may be modeled out of the mesh screen which is previously coated with a releasable material.

The regenerative plate 131 may have both surfaces coated with a releasable material to form temporary layers. In this case, each of temporary layers has a thickness of 5 $\mu$m or less substantially equal to a half of the distance of the space between the neighboring two regenerative plates 131 in the heat exchanging unit 130.

The releasable material is made of a photosensitive resist material, for example, including azide and isoprene rubber.

The regenerative plates 131 may be made of a thin plate smaller in size than that of the cross-section of the gas chamber 113 of the gas casing 111. The thin plate may be made of stainless steel or copper. In this case, the above plate preparing step (a) may have the step of (a1) preparing a plurality of thin plates each having a thickness of 30–100 $\mu$m to have a first surface and a second surface opposite to said first surface. Furthermore, the above depositing step (b) may have the steps of: (b1) depositing a photosensitive resist material on the thin plates to pattern the thin plates with a predetermined porous pattern to form the temporary layers 133; and (b2) exposing the resist deposited thin plates to the light to etch and perforate the thin plates in accordance with the porous pattern to form the processed regenerative plates 136 each having a plurality of airy holes as well as the temporary layer 133. This results in the fact that the resist material can serve for formation of porous regenerative plate 131 as well as deposition of the temporary layer 133.

Figure 5:
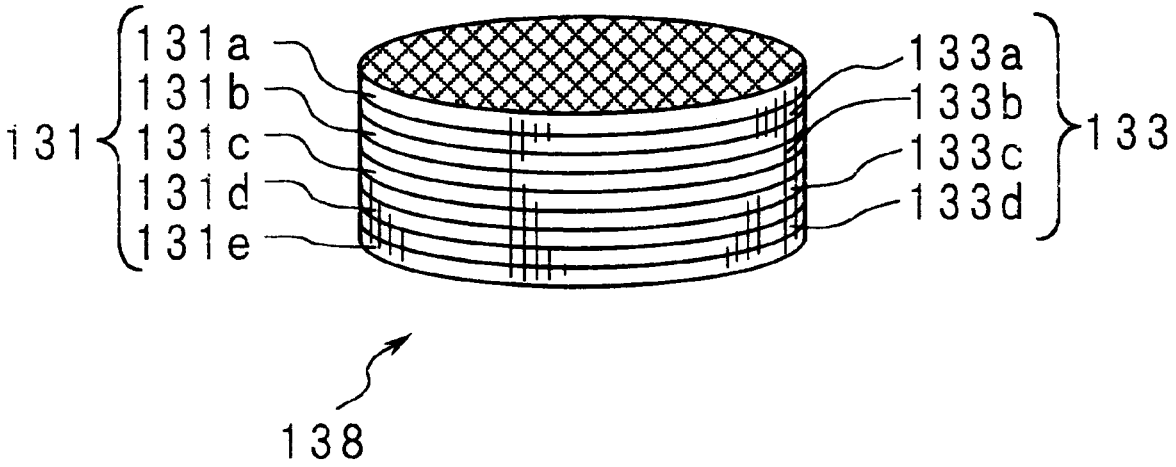

The method of producing the heat exchanging unit 130 further comprises the step of (c) situating a plurality of the processed regenerative plates 136 in face-to-face relationship to one another to form a stack 138 of the processed regenerative plates 136 so that each of the temporary layers 133 intervenes between the neighboring two regenerative plates 131 as shown in FIG. 5.

Figure 6:
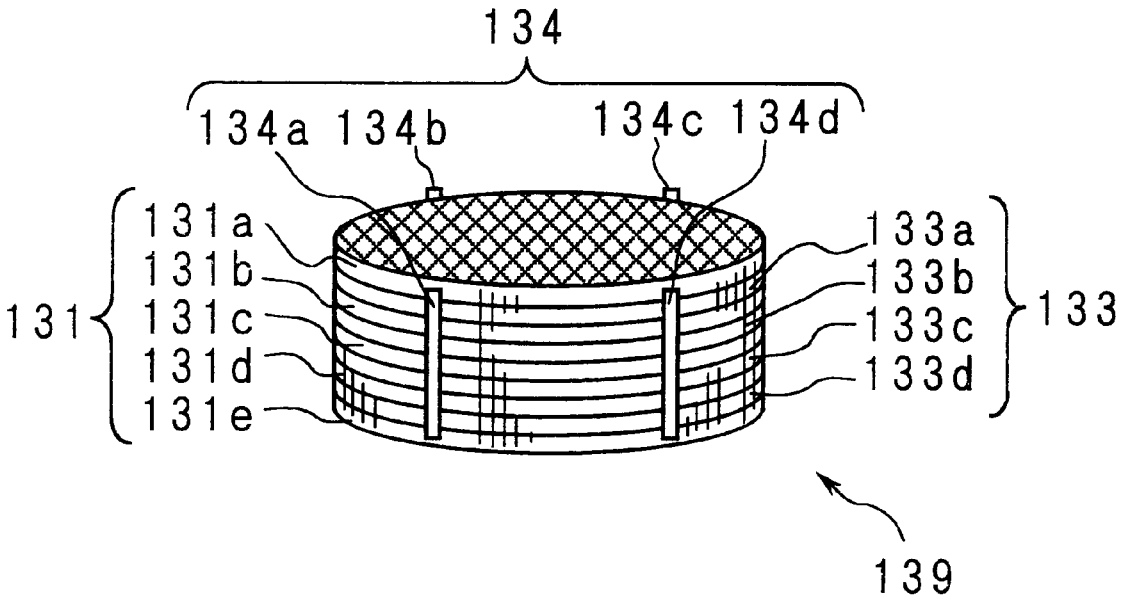

The method of producing the heat exchanging unit 130 further comprises the step of (d) mechanically and partially connecting the regenerative plates 131 in the stack 138 with one another to form a provisional unit 139 in which the plurality of regenerative plates 131 are retained in face-to-face relationships to one another as shown in FIG. 6.

The processed regenerative plates 136 in the stack 138 are mechanically and partially connected to one another by the connecting parts 134 to retain the processed regenerative plates 136 in face-to-face relationship with one another.

Each of the processed regenerative plates 136 has a circumferential border portion. The circumferential border portions of the processed regenerative plates 136 collectively define an outside portion of the stack 138. In this embodiment, the regenerative plates 131 are partially secured at the outside portion of the stack 138 by the connecting parts 134 made of an adhesive material.

Each of the connecting parts 134 may be made of a solder to have the regenerative plates 131 partially secured to one another at the outside portion of the stack 138. Alternatively, the regenerative plates 131 may be partially welded to each other by way of laser welding or electric arc welding to form into a plurality of connecting portions.

The connecting step (d) further has the step of scraping the convex portion from the outer surface of the provisional unit 139 to have the connecting parts 134 leveled with the circumferential border portion of the regenerative plates 131 to define an even outer surface of the heat exchanging unit 130. The heat exchanging unit 130 can be thus snugly received in the gas chamber 113 of the gas casing 111.

Figure 7:
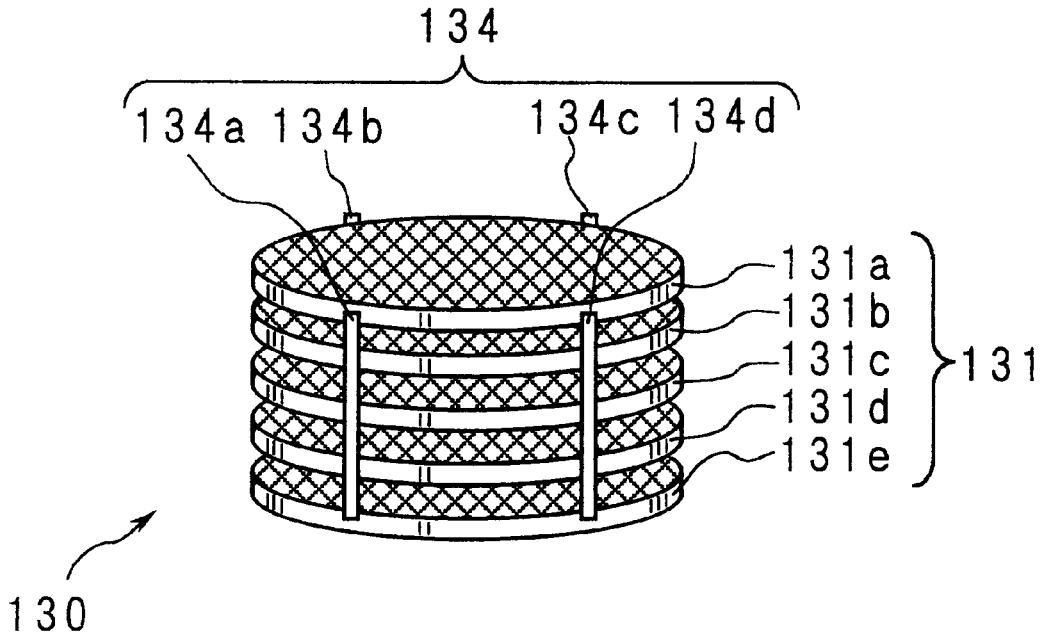

The method of producing the heat exchanging unit 130 further comprises the step of (e) removing the temporary layers 133 from the provisional unit 139 to form a heat exchanging unit 130 having a center axis and spaces each between the neighboring two regenerative plates 131 as shown in FIG. 7. The temporary layers 133 may be removed from the provisional unit 139 by immersing the provisional unit 139 in a resist solvent material, such as xylene.

A several heat exchanging units 130 are thus situated in the gas chamber 113 of the gas casing 111 to fabricate the heat exchanger. The center axes of the heat exchanging units 130 are in coaxial relationship with the center axis of the gas casing 111 to have the first and second flat surfaces of the regenerative plates 131 in substantially perpendicular to the center axis of each of the heat exchanging units 130. The airy holes of the regenerative plates 131 and part of the spaces between the regenerative plates 131 define in combination a plurality of inner gas flow passageways extending in substantially perpendicular relationship to the first and second flat surfaces of the regenerative plates 131 to allow the refrigerant gas to flow therethrough to effect a heat exchange between the regenerative plates 131 and the refrigerant gas therethrough while the refrigerant gas is passing through the first and second ports 111*a* and 111*b* of the gas casing 111.

Therefore, the heat exchanger according to the present invention can be effectively fabricated in comparison with the prior-art of the heat exchanger which is constructed by situating a large number of regenerative plates in the gas chamber 113 of the gas casing 111 one by one by hand.

Furthermore, the heat exchanging unit 130 has spaces each between the neighboring two regenerative plates 131, thereby preventing the heat energy from transferring between the neighboring two regenerative plates 131 of the heat exchanging unit 130 in a direction parallel with the gas flow passageways of the heat exchanging unit 130. Therefore, the efficiency of the heat exchange between the regenerative plates 131 and the refrigerant gas in the heat exchanger can be improved.

The adhesive material of the connecting part 134 may be preferably made of a resin material, such as fluorocarbon. The resin material should be insoluble of the aforesaid resist solvent material which is used in the removing step (e). Alternatively, the adhesive material of the connecting parts 134 may be an organic solvent material, such as ether, but should be insoluble of the aforesaid resist solvent material. These type of the adhesive material of the connecting part 134 has an advantage in having a relatively lower heat conductivity, thereby preventing the deterioration of the heat exchanging capacity of the constructed heat exchanging unit 130.

Referring now to FIGS. 8 to 11 of the drawings, there is shown a second embodiment of the heat exchanger according to the present invention. In this embodiment, the heat exchanger comprises a plurality of heat exchanging units 230.

Figure 10:
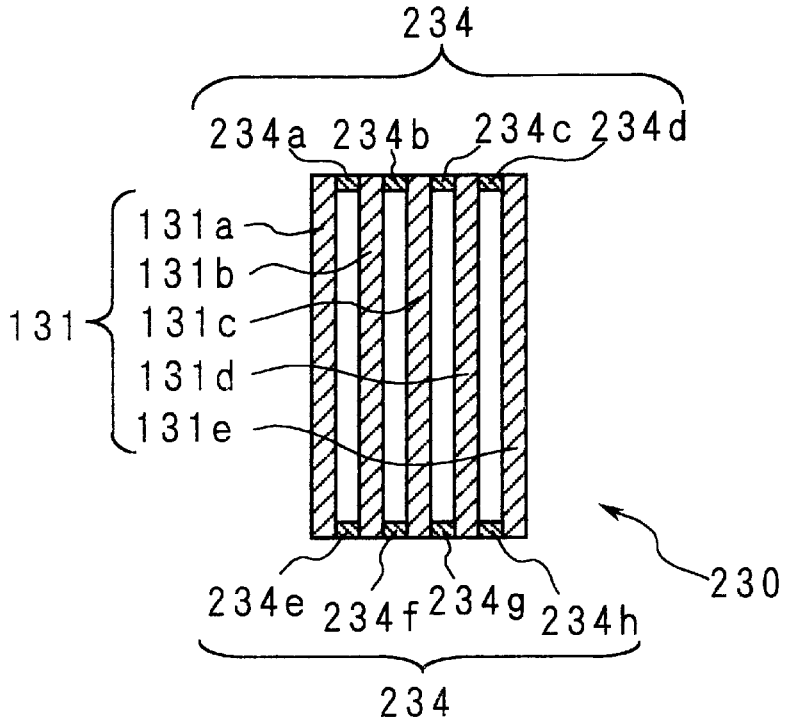

As shown in FIG. 10, the heat exchanging unit 230 comprises a plurality of regenerative plates which are the same as those of the first embodiment of the heat exchanging unit 130 shown in FIG. 2. These same regenerative plates are simply represented by the same reference numerals "131" as those of the first embodiment. The descriptions of these same constitutional elements will thus be omitted from the following description for avoiding tedious repetition.

The heat exchanging unit 230 further comprises a plurality of connecting parts 234*a*, 234*b*, 234*c*, 234*d*, 234*e*, 234*f*, 234*g*, and 234*h*, as shown in FIG. 10 and hereinlater referred to simply as "234". The connecting parts 234 are adapted to mechanically and partially connect and retain the plurality of regenerative plates 131 in face-to-face and thermally insulated relationships to one another to define spaces each between the neighboring two regenerative plates 131. The circumferential border portions of the regenerative plates 131 collectively define an outside portion of the heat exchanging unit 230. The regenerative plates 131 are partially secured to one another at the outside portion of the heat exchanging unit 230 by the connecting parts 234.

The method of producing the second embodiment of the heat exchanging unit 230 shown in FIG. 10 will be described hereinlater with reference to FIGS. 8 to 11 of the drawings.

The method of producing the heat exchanging unit 230 comprises the steps of: (a) preparing a plurality of regenerative plates 131; and (b) preparing a plurality of temporary plates 233 each made of a releasable material. In this embodiment, the temporary plates 233 are constituted by four temporary plates 233*a*, 233*b*, 233*c* and 233*d*. Each of the temporary plates 233 have a thickness of 10 $\mu$m or less substantially equal to the distance of the space between the neighboring two regenerative plates 131 in the heat exchanging unit 230 and an outline substantially smaller in size than that of said regenerative plate 131.

Figure 8:
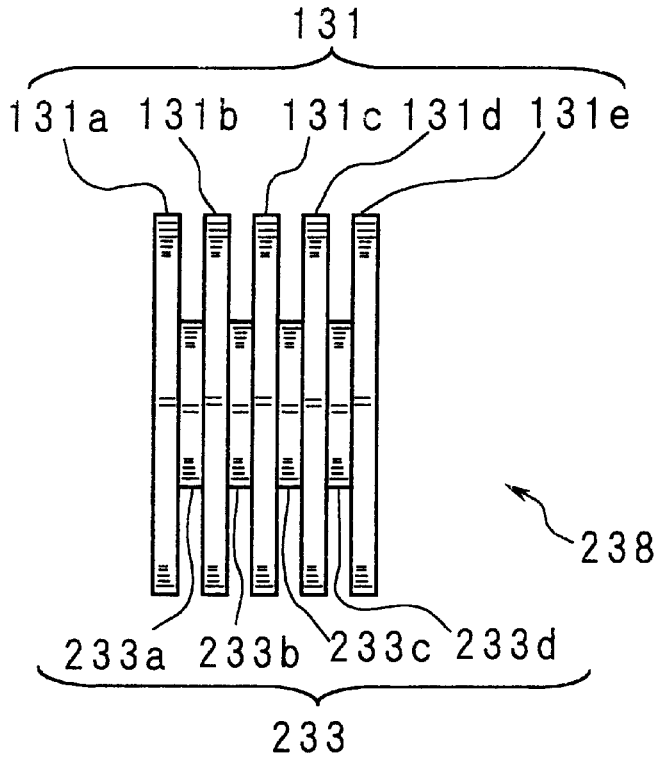
FIGS. 8 to 11 are schematic views collectively illustrating a method of producing a second embodiment of the heat exchanger according to the present invention.

The method of producing the heat exchanging unit 230 comprises the step of (c) situating a plurality of regenerative plates 131 and temporary plates 233 by turn in face-to-face relationship with one another to form a stack 238 of the plates 131 and 233, so that each of the temporary plates 233 is interposed between the neighboring two regenerative plates 131 as shown in FIG. 8.

Figure 9:
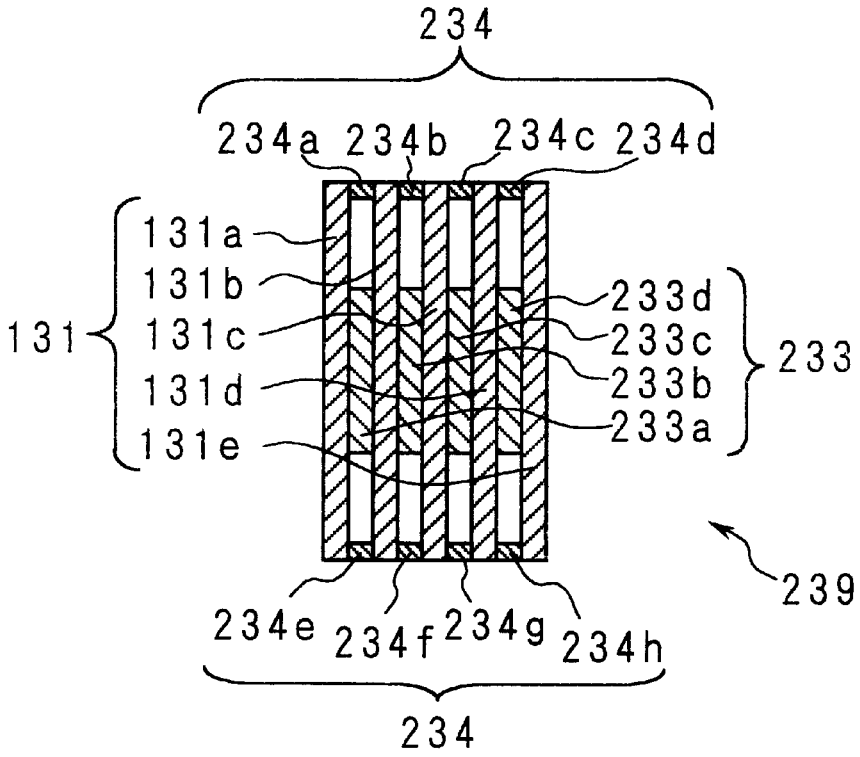

The method of producing the heat exchanging unit 230 comprises the step of (d) mechanically and partially connecting the regenerative plates 131 in the stack 238 with one another to form a provisional unit 239 in which the regenerative plates 131 and the temporary plates 233 are retained in face-to-face relationship to one another as shown in FIG. 9.

The regenerative plates 131 and the temporary plates 233 in the stack 238 are mechanically and partially connected with one another by a plurality of connecting parts 234 to retain the regenerative plates 131 and the temporary plates 233 in face-to-face relationship to one another. The circumferential border portions of the regenerative plates 131 in the stack 238 collectively define an outside portion of the stack 238. In this embodiment, the regenerative plates 131 are partially secured to one another at the outside portion of the stack 238 by the connecting parts 234 made of an adhesive material.

As shown in FIG. 9, each of the connecting parts 234 is interposed between the neighboring two regenerative plates 131 at the circumferential portion to have its circumferential border portion leveled with the circumferential border portion of the regenerative plates 131 to define an even outer surface of the heat exchanging unit 230. Each of the connecting parts 234 may be continuously formed around the circumferential portion of each of the regenerative plates 131. Alternatively, each of the connecting parts 234 may be partly formed around the circumferential portion of each of the regenerative plates 131.

Each of the connecting parts 234 may be made of a solder to have the regenerative plates 131 partially secured to one another at the outside portion of the stack 238. Alternatively, the regenerative plates 131 may be partially welded to each other by way of laser welding or electric arc welding to form into a plurality of connecting portions.

The method of producing the heat exchanging unit 230 comprises the step of (e) removing the temporary plates 233 from the provisional unit 239 to form a heat exchanging unit 230 having a center axis and spaces each between the neighboring two regenerative plates 131 as shown in FIG. 10. The temporary plates 233 are removed from the provisional unit 239 by immersing the provisional unit 239 in the resist solvent, such as xylene.

The connecting step (d) further has the step of scraping the convex portion from the outer surface of the provisional unit 239 to have the connecting parts 234 leveled with the circumferential border portion of the regenerative plates 131 to define an even outer surface of the heat exchanging unit 230.

Figure 11:
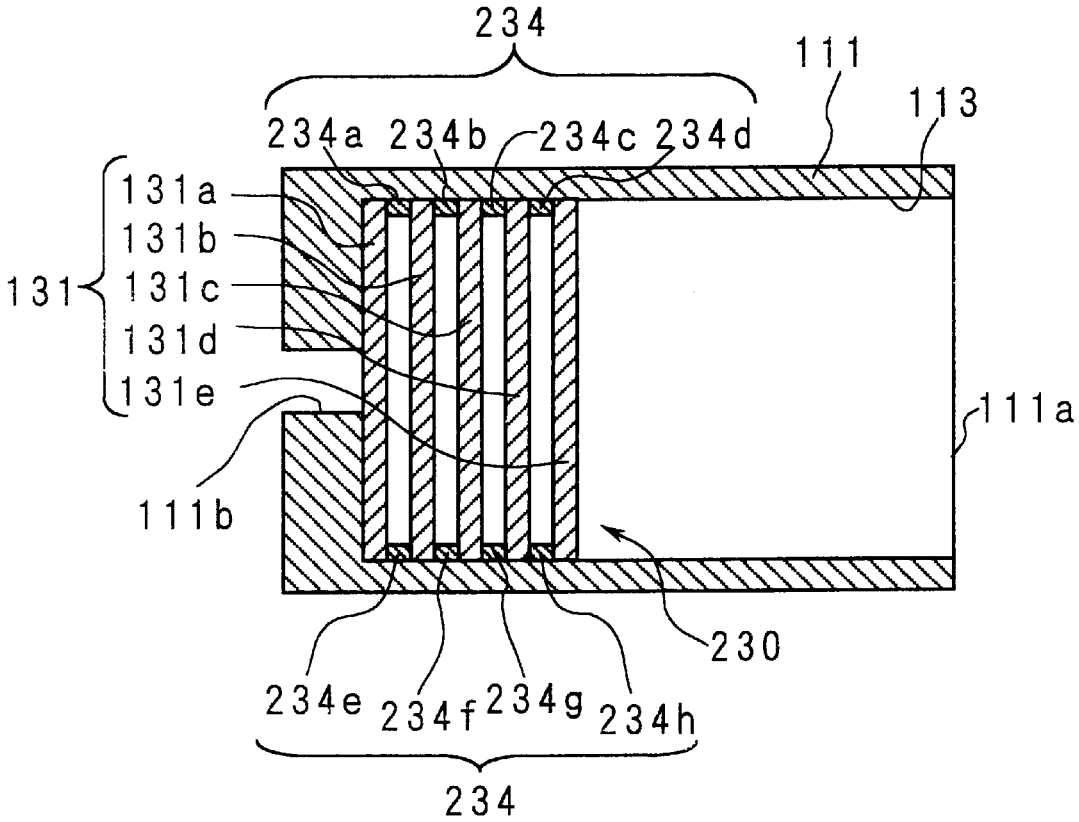

A several heat exchanging units 230 are thus situated in the gas chamber 113 of the gas casing 111 to fabricate the heat exchanger. In FIG. 11, there is shown a heat exchanging unit 230 situated in the gas chamber 113 of the gas casing 111. The center axes of the heat exchanging units 230 are in coaxial relationship with the center axis of the gas casing 111 to have the first and second flat surfaces of the regenerative plates 131 in substantially perpendicular to the center axis of each of the heat exchanging units 230. The airy holes of the regenerative plates 131 and part of the spaces between the regenerative plates 131 define in combination a plurality of inner gas flow passageways extending in substantially perpendicular relationship to the first and second flat surfaces of the regenerative plates 131 to allow the refrigerant gas to flow therethrough to effect a heat exchange between the regenerative plates 131 and the refrigerant gas therethrough while the refrigerant gas is passing through the first and second ports 111*a* and 111*b* of the gas casing 111.

The heat exchanging unit 230 thus constructed can effectively perform the heat exchange between the regenerative plates and the refrigerant gas, because of the fact that the heat energy is prevented from transferring between the neighboring two regenerative plates 131 in the heat exchanging unit 230.

Referring now to FIGS. 12 to 15 of the drawings, there is shown a third embodiment of the heat exchanger according to the present invention. In this embodiment, the heat exchanger comprises a plurality of heat exchanging units 330.

Figure 15:
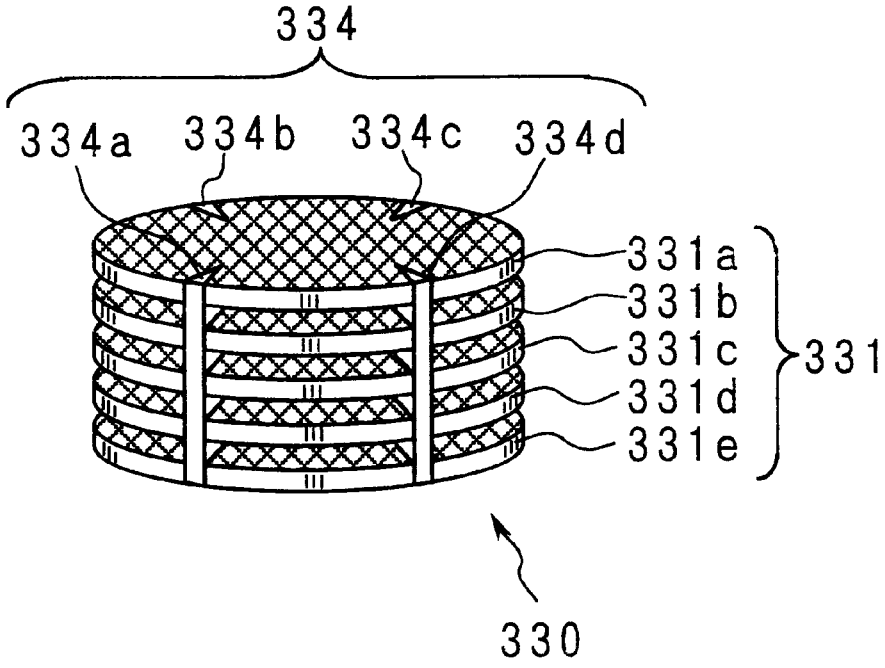

As shown in FIG. 15, each of the heat exchanging units 330 comprises a plurality of regenerative plates 331 including five regenerative plates 331*a*, 331*b*, 331*c*, 331*d* and 331*e*, and a plurality of connecting parts 334 including four connecting parts 334*a*, 334*b*, 334*c* and 334*d*. The number of regenerative plates 331 is in practice hundreds.

Each of the regenerative plates 331 is the same as that of the regenerative plates 131 shown in FIG. 2, except that each of the regenerative plates 331 has a circumferential border portion formed with four concave portions 335*a*, 335*b*, 335*c* and 335*d* which are hereinlater referred to simply as "335". The concave portions 335 of the regenerative plates 331 and part of the spaces in the heat exchanging unit 330 define in combination a plurality of grooves extending on the outside surface of the heat exchanging unit 330 in substantially parallel relationship with the center axis of the heat exchanging unit 330. The connecting parts 334 are respectively fitted into the grooves of the heat exchanging unit 330 to have the regenerative plates 331 partially connected to one another at the concave portions 335 around its circumferential portion.

The method of producing the second embodiment of the heat exchanging unit 330 shown in FIG. 15 will be described hereinlater with reference to FIGS. 12 to 15 of the drawings.

Figure 12:
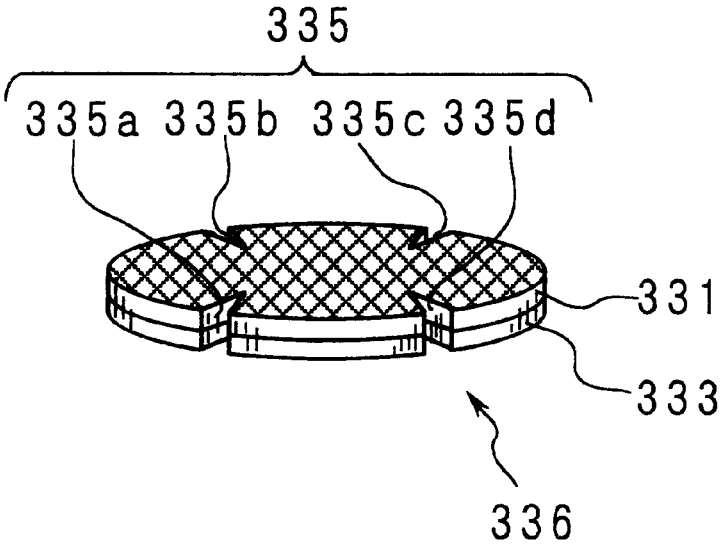
FIGS. 12 to 15 are schematic views collectively illustrating a method of producing a third embodiment of the heat exchanger according to the present invention.

The method of producing the heat exchanging unit 330 comprises the step of (a) preparing a plurality of regenerative plates 331. The preparing step (a) has the step of forming a plurality of concave portions 335 in the circumferential portion of each of the regenerative plates 331. Each of the regenerative plates 331 is made of a material same as that of the regenerative plates 131 shown in FIG. 4. In this embodiment, as shown in FIG. 12, the circumferential border portion of each of the regenerative plates 331 is formed with a plurality of concave portions 335.

The method of producing the heat exchanging unit 330 comprises the step of (b) depositing a releasable material same as that of the regenerative plates 131 shown in FIG. 4 on at least one of the first and second flat surfaces of each of the regenerative plates 331 to form a temporary layer 333. The temporary layer 333 has a thickness of 10 $\mu$m or less substantially equal to the distance of the space between the neighboring two regenerative plates 331 in the heat exchanging unit 330. The regenerative plate 331 on which the temporary layer 333 is deposited is referred to as "processed regenerative plate" and indicated by the reference numeral "336" as shown in FIG. 12.

Figure 13:
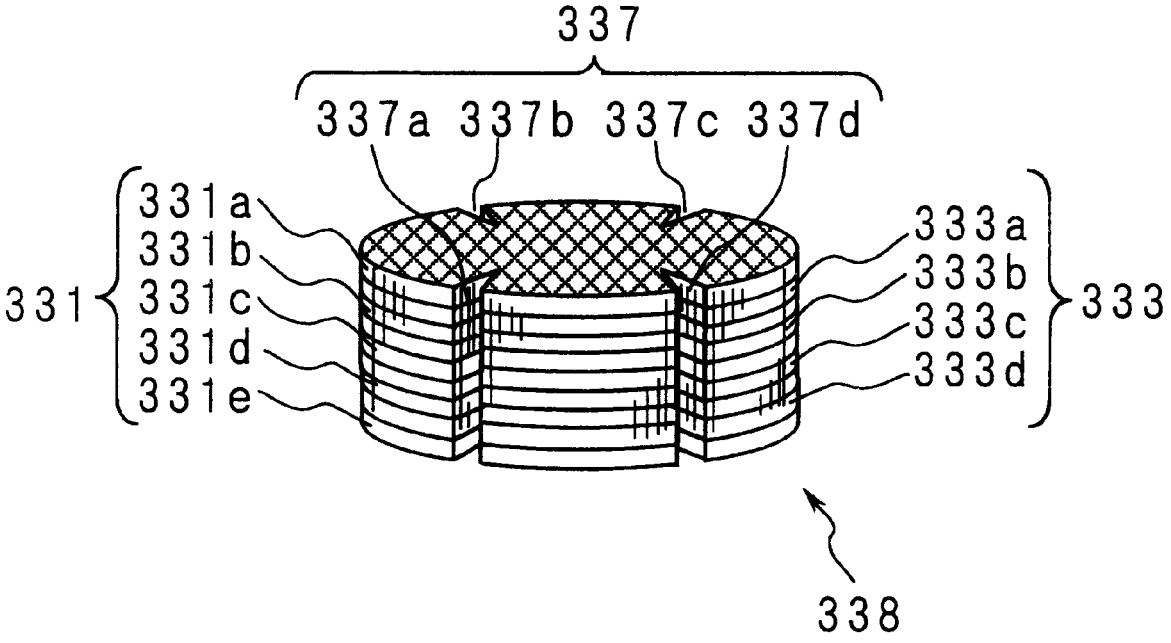

The method of producing the heat exchanging unit 330 comprises the step of (c) situating the processed regenerative plates 336 in face-to-face relationship to one another to form a stack 338 of the processed regenerative plates 336, so that each of the temporary layers 333 intervenes between the neighboring two regenerative plates 331 as shown in FIG. 13. The circumferential border portions of the regenerative plates 331 collectively define an outside portion of the heat exchanging unit 330. The concave portions 335 of the processed regenerative plates 336 define a plurality of grooves 337*a*, 337*b*, 337*c* and 337*d* (hereinlater referred to simply as "337") extending on the outside surface of the stack 338 in substantially parallel relationship with the center axis of the stack 338.

The method of producing the heat exchanging unit 330 further comprises the step of (d) mechanically and partially connecting the regenerative plates 331 in the stack 338 with one another to form a provisional unit 339 in which the plurality of regenerative plates 331 are retained in face-to-face relationships to one another. The connecting step (d) had the step of inserting an adhesive material into the grooves 337 of the stack 338 to have the regenerative plates 331 partially connected to one another at the concave portions 335 around its circumferential portion.

Figure 14:
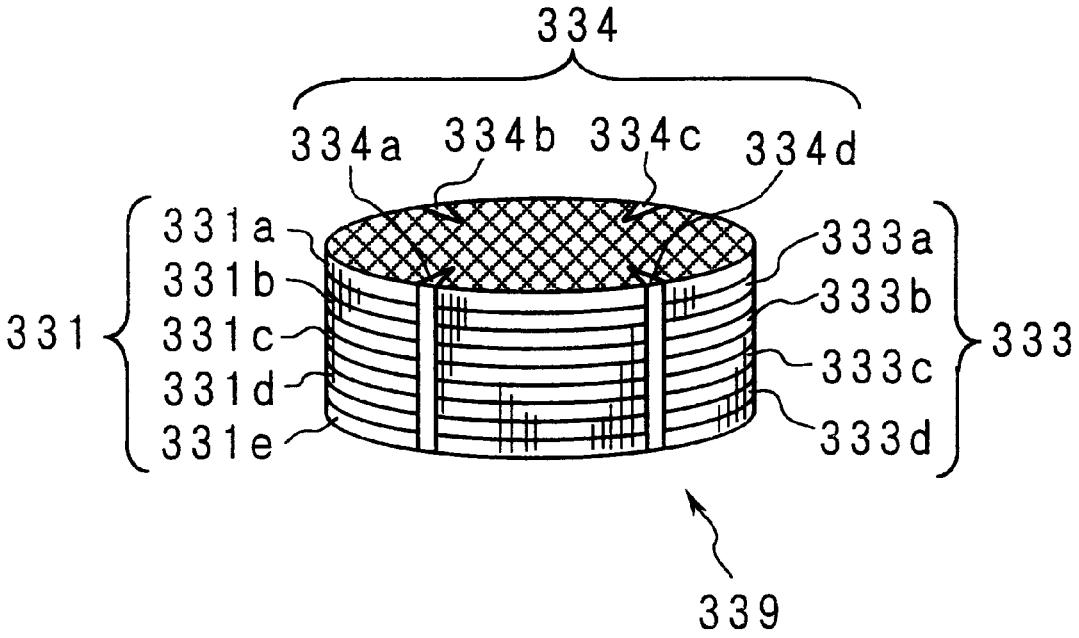

As shown in FIG. 14, the processed regenerative plates 336 in the stack 338 are mechanically and partially connected to one another by a plurality of connecting parts 334 to retain the processed regenerative plates 336 in face-to-face relationship with one another. The regenerative plates 331 are partially connected to one another at the concave portions 335 around its circumferential portion by the connecting parts 334 to from a provisional unit 339. Each of connecting parts 334 has its circumferential portion leveled with the circumferential border portion of the regenerative plates 331 to define an even outer surface of the heat exchanging unit 330. In this embodiment, there is no need to have the scraping step of scraping the convex portion from the outer surface of the heat exchanging unit 330.

Each of the connecting parts 334 may be made of a solder to have the regenerative plates 331 partially secured to one another at the grooves 337 of the stack 338. Alternatively, the regenerative plates 331 may be partially welded to each other at the grooves 337 of the stack 338 by way of laser welding or electric arc welding.

The method of producing the heat exchanging unit 330 further comprises the step of (e) removing the temporary layers 333 from the provisional unit 339 to form a heat exchanging unit 330 having a center axis and spaces each between the neighboring two regenerative plates 331 as shown in FIG. 15. The temporary layers 333 are removed from the provisional unit 339 by immersing the provisional unit 339 in the resist solvent, such as xylene.

A several heat exchanging units 330 are thus situated in the gas chamber 113 of the gas casing 111 to fabricate the heat exchanger. The center axes of the heat exchanging units 330 are in coaxial relationship with the center axis of the gas casing 111 to have the first and second flat surfaces of the regenerative plates 331 in substantially perpendicular to the center axis of each of the heat exchanging units 330. The airy holes of the regenerative plates 331 and part of the spaces between the regenerative plates 331 define in combination a plurality of inner gas flow passageways extending in substantially perpendicular relationship to the first and second flat surfaces of the regenerative plates 331 to allow the refrigerant gas to flow therethrough to effect a heat exchange between the regenerative plates 331 and the refrigerant gas therethrough while the refrigerant gas is passing through the first and second ports 111*a* and 111*b* of the gas casing 111.

The heat exchanging unit 330 thus constructed can effectively perform the heat exchange between the regenerative plates and the refrigerant gas, because of the fact that the heat energy is prevented from transferring between the neighboring two regenerative plates 331 in the heat exchanging unit 330.

Referring now to FIGS. 16 to 22 of the drawings, there is shown a fourth embodiment of the heat exchanger according to the present invention. In this embodiment, the heat exchanger comprises a plurality of heat exchanging units 430.

Figure 16:
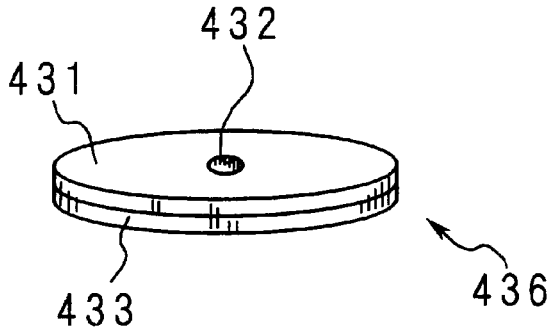
FIGS. 16 to 22 are schematic views collectively illustrating a method of producing a fourth embodiment of the heat exchanger according to the present invention.
Figure 21:
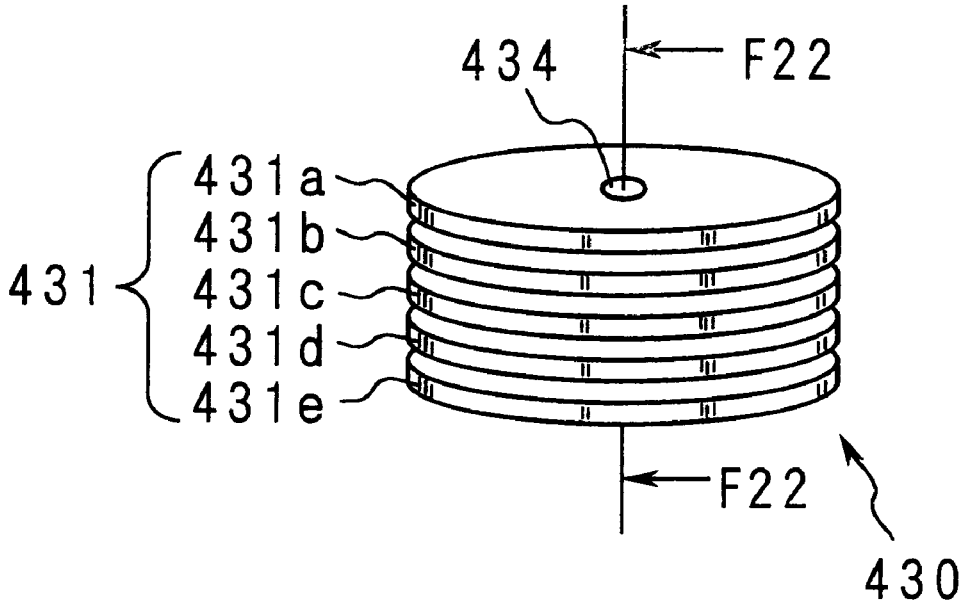
Figure 22:
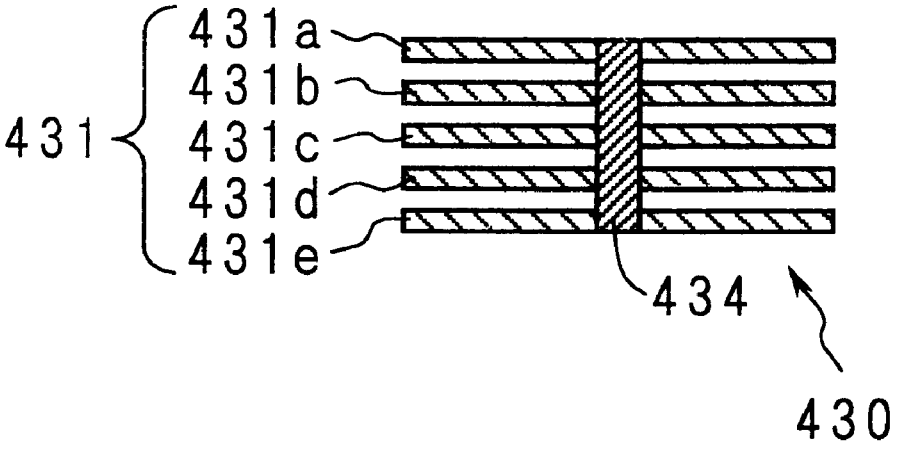

As shown in FIGS. 21 and 22, each of the heat exchanging units 430 comprises a plurality of regenerative plates 431 including five regenerative plates 431*a*, 431*b*, 431*c*, 431*d* and 431*e*, and a connecting part 434. Each of the regenerative plates 431 is the same as that of the regenerative plates 131 shown in FIG. 2, except that each of the regenerative plates 431 has a central portion formed with a central hole 432 larger in size than the airy holes as shown in FIG. 16. The central holes 432 of the regenerative plates 431 and part of the spaces in the heat exchanging units 430 define in combination a center longitudinal through bore extending into the heat exchanging unit 430. The connecting part 434 are shaped in the form of rod piercing through the center longitudinal through bore to partially connect the regenerative plates 431 to one another.

The method of producing the second embodiment of the heat exchanging unit 430 shown in FIGS. 21 and 22 will be described hereinlater with reference to FIGS. 16 to 22 of the drawings.

The method of producing the heat exchanging unit 430 comprises the step of (a) preparing a plurality of regenerative plates 431. The preparing step (a) has the step of forming each of the regenerative plates 431 with a central hole 432 lager in size than the airy holes at its central portion. Each of the regenerative plates 431 is made of a material same as that of the regenerative plates 131 shown in FIG. 4.

The method of producing the heat exchanging unit 430 comprises the step of (b) depositing a releasable material same as that of the regenerative plates 131 shown in FIG. 4 on at least one of the first and second flat surfaces of each of the regenerative plates 431 to form a temporary layer 433. The temporary layer 433 has a thickness of 10 $\mu$m or less substantially equal to the distance of the space between the neighboring two regenerative plates 431 in the heat exchanging unit 430. The regenerative plate 431 on which the temporary layer 433 is deposited is referred to as "processed regenerative plate" and indicated by the reference numeral "436", as shown in FIG. 16.

Figure 17:
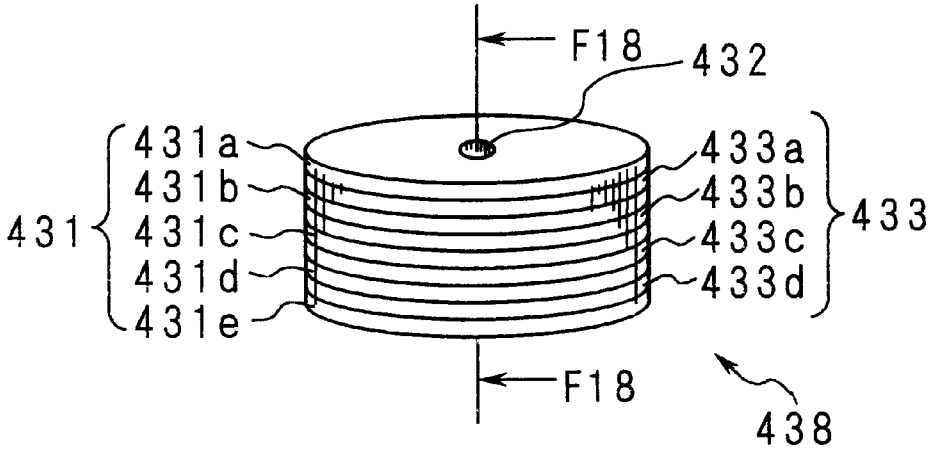
Figure 18:
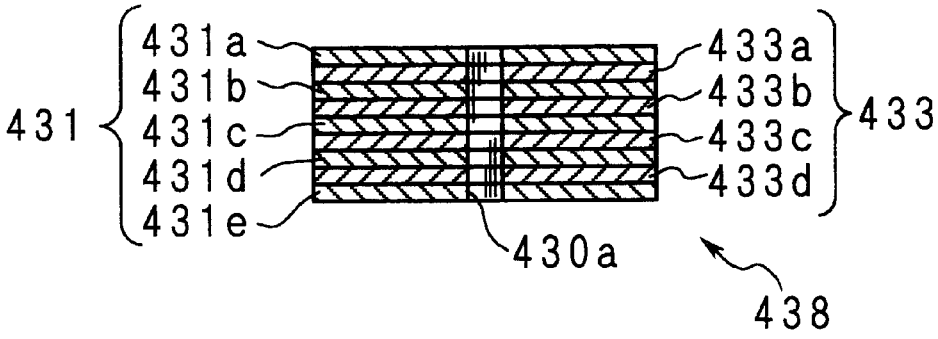

The method of producing the heat exchanging unit 430 comprises the step of (c) situating a plurality of regenerative plates 431*a*, 431*b*, 431*c*, 431*d* and 431*e* (hereinlater referred to simply as "431") and a plurality of temporary layers 433*a*, 433*b*, 433*c* and 433*d* (hereinlater referred to simply as "433") by turn in face-to-face relationship with one another to form a stack 438 of the regenerative plates 431, so that each of the temporary layers 433 is interposed between the neighboring two regenerative plates 431 as shown in FIGS. 17 and 18. The number of regenerative plates 431 and temporary layers 433 is in practice hundreds.

As shown in FIG. 18, the central holes of the regenerative plates 431 and temporary layers 433 define a center longitudinal through bore 430*a* extending in the stack 438.

The method of producing the heat exchanging unit 430 comprises the step of (d) mechanically and partially connecting the regenerative plates 431 in the stack 438 with one another to form a provisional unit 439 in which the regenerative plates 431 and the temporary layers 433 are retained in face-to-face relationship to one another.

The connecting step (d) has the step of piercing the central holes 432 of the regenerative plates 431 with an adhesive material in the form of rod piercing through the center longitudinal through bore 430*a* of the stack 438 to partially connect the regenerative plates 431 to one another.

Figure 19:
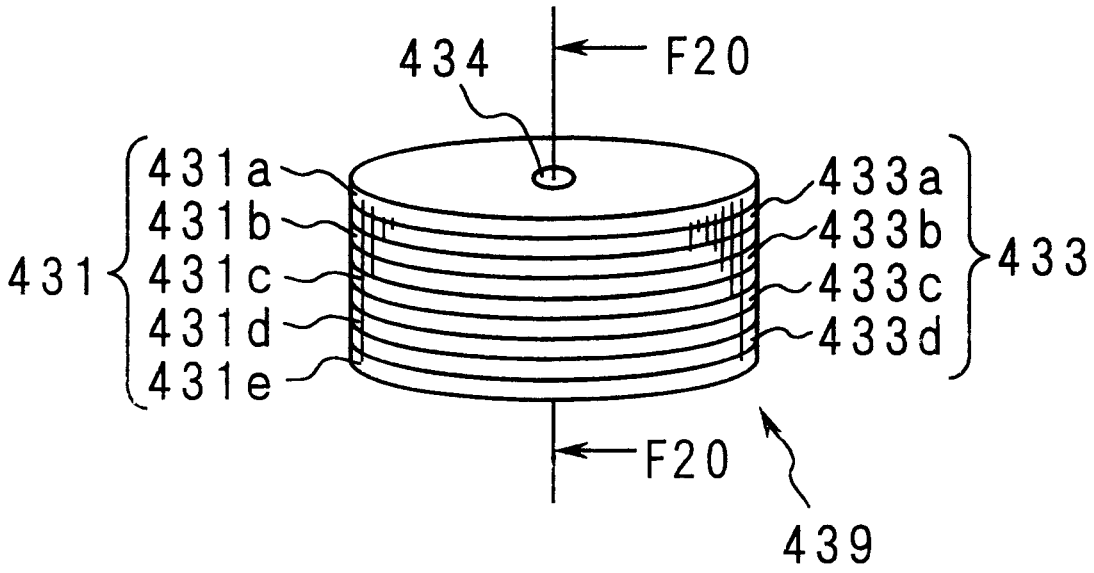
Figure 20:
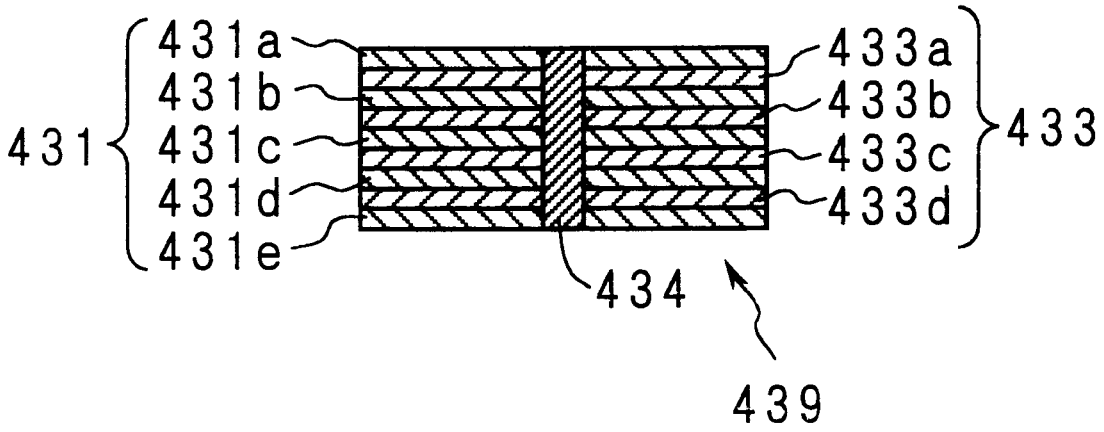

As shown in FIGS. 19 and 20, the regenerative plates 431 in the stack 438 are mechanically and partially connected to one another by a connecting part 434 to retain the processed regenerative plates 436 in face-to-face relationship with one another. The connecting part 434 is made of an adhesive material in the form of rod piercing through the center longitudinal through bore 430*a* of the stack 438 to partially connect the regenerative plates 431 to one another.

The connecting part 434 may be made of a solder inserted into the center longitudinal through bore 430*a* of the stack 438 to have the regenerative plates 431 partially secured to one another.

The method of producing the heat exchanging unit 430 comprises the step of (e) removing the temporary layers 433 from the provisional unit 439 to form a heat exchanging unit 430 having a center axis and spaces each between the neighboring two regenerative plates 431 as shown in FIGS. 21 and 22. The temporary layers 433 are removed from the provisional unit 439 by immersing the provisional unit 439 in the resist solvent, such as xylene.

A several heat exchanging units 430 are thus situated in the gas chamber 113 of the gas casing 111 to fabricate the heat exchanger. The center axes of the heat exchanging units 430 are in coaxial relationship with the center axis of the gas casing 111 to have the first and second flat surfaces of the regenerative plates 431 in substantially perpendicular to the center axis of each of the heat exchanging units 430. The airy holes of the regenerative plates 431 and part of the spaces between the regenerative plates 431 define in combination a plurality of inner gas flow passageways extending in substantially perpendicular relationship to the first and second flat surfaces of the regenerative plates 431 to allow the refrigerant gas to flow therethrough to effect a heat exchange between the regenerative plates 431 and the refrigerant gas therethrough while the refrigerant gas is passing through the first and second ports 111*a* and 111*b* of the gas casing 111.

Figure 23:
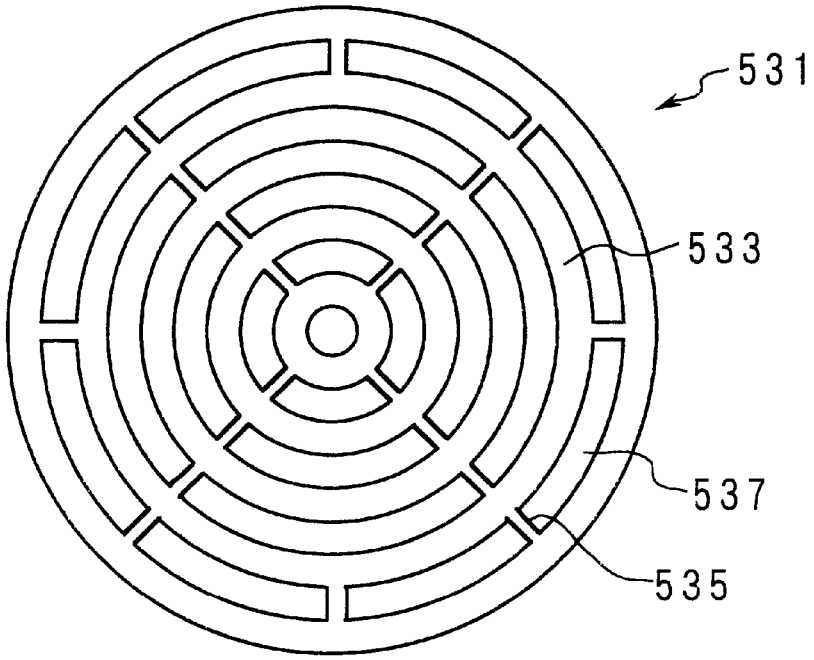
FIG. 23 is a front view of a regenerative plate adaptable for use in a fifth embodiment of the heat exchanger according to the present invention.
Figure 24:
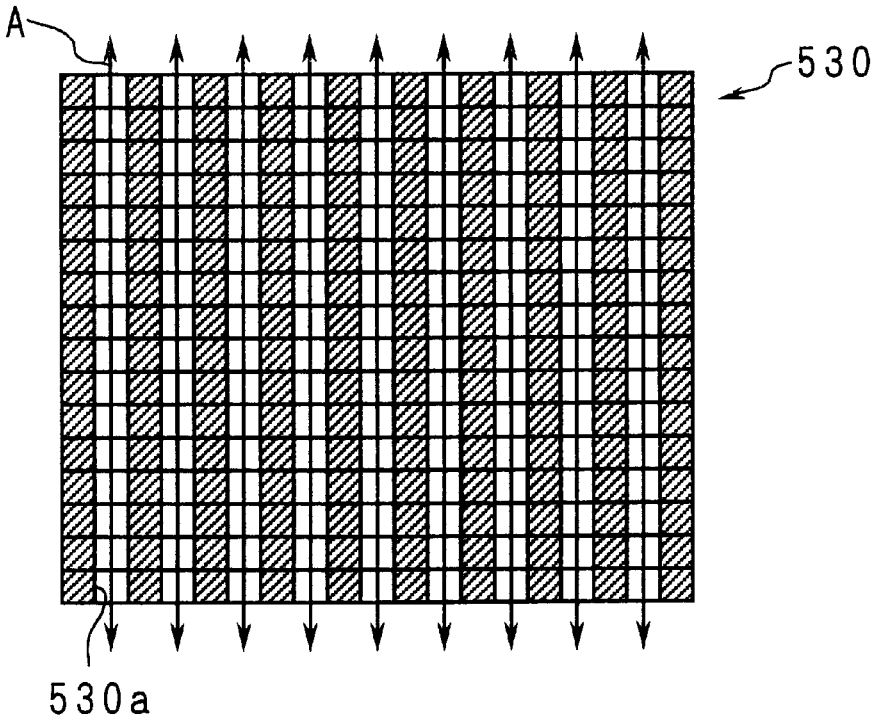
FIG. 24 is a cross-sectional view of a regenerative heat exchanging unit constituted by a plurality of the regenerative plates shown in FIG. 23.

Referring now to FIGS. 23 and 24 of the drawings, there is shown a fifth embodiment of the heat exchanger according to the present invention.

In this embodiment, the heat exchanger comprises a hermetically sealed gas casing, not shown in FIGS. 23 and 24, but same as that of the first embodiment. These same constitutional elements are simply represented by the same reference numerals as those of the first embodiment. The descriptions of these same constitutional elements will thus be omitted from the following description for avoiding tedious repetition.

The heat exchanger further comprises a heat exchanging unit 530 having a center axis and a plurality of regenerative plates 531, as shown in FIGS. 23 and 24. The heat exchanging unit 530 is received in the gas chamber 113 of the gas casing 111 with the center axis thereof being in coaxial relationship with the center axis of the gas casing 111. Each of regenerative plates 531 has a thickness to have a first flat surface and a second flat surface opposite to the first flat surface. The regenerative plates 531 are situated in face-to-face relationships with one another to have the first and second flat surfaces substantially perpendicular to the center axis of the heat exchanging unit 530. Each of the regenerative plates 531 is made of a material having a thermal conductivity and a heat capacity. In practice, the number of the regenerative plates 531 in the heat exchanging unit 530 is 2000.

As shown in FIG. 23, each of the regenerative plates 531 has a central point and is shaped in the symmetrical outline form with respect to the central point and smaller in size than the cross-sections of the gas chamber 113 of the gas casing 111. Each of the regenerative plates 531 has a plurality of circumferential rib portions 533 each having a width and circumferentially extending along the outline of the regenerative plate 531. In this embodiment, each of the regenerative plates 531 has five circumferential rib portions 533, but in practice a large number of circumferential rib portions 533. The circumferential rib portions 533 are arranged in concentric relationship with respect to the central point of the regenerative plate 531 and radially spaced apart from one another. Each of the regenerative plates 531 has a plurality of radial rib portions 535 each having a width narrower than that of each of the circumferential rib portions 533 and radially extending from the central point thereof and angularly spaced apart from one another. The circumferential rib portions 533 and the radial rib portions 535 define as a whole a plurality of slits 537 radially outwardly of the central point of the regenerative plates 531 and radially and circumferentially spaced apart from one another.

As shown in FIG. 24, the plurality of slits 533 of the regenerative plates 531 define a plurality of inner gas flow passageways 530*a* in the heat exchanging unit 530 in substantially perpendicular relationship to the first and second flat surfaces of the regenerative plates 531 to allow the refrigerant gas to flow therethrough to effect a heat exchange between the regenerative plates 531 and the refrigerant gas therethrough while the refrigerant gas is passing through the first and second ports 111*a* and 111*b* of the gas casing 111. In this embodiment, the refrigerant gas can be allowed to flow through the gas flow passageways 530*a* along straight lines represented by double headed arrows "A" in FIG. 24. The aforesaid heat exchanging unit 530 can be constructed by inserting a plurality of regenerative plates 531 by hand at random without any attention to relations between the regenerative plates 531.

In this embodiment, the heat exchanger further comprises a plurality of spacers, not shown, each intervening between the regenerative plates 531 to have the regenerative plates 531 situated in face-to-face and thermally insulated relationships with one another in the gas chamber 113 of the gas casing 111 to define spaces each between the neighboring two regenerative plates 531. The spacer may be made of stainless steel to have a ring-shaped form having an outer diameter substantially equal to that of each of the regenerative plates 531 and a thickness of 0.03 mm. Alternatively, the spacers may be constructed of the connecting parts of either one of the first to fourth embodiments.

The plurality of slits 533 of the regenerative plates 531 and part of the spaces in the heat exchanging units 530 define in combination a plurality of inner gas flow passageways 530*a* in the heat exchanging unit 530 in substantially perpendicular relationship to the first and second flat surfaces of the regenerative plates 531 to allow the refrigerant gas to flow therethrough to effect a heat exchange between the regenerative plates 531 and the refrigerant gas therethrough while the refrigerant gas is passing through the first and second ports 111*a* and 111*b* of the gas casing 111.

The heat exchanging unit 530 thus constructed can more effectively perform the heat exchange between the regenerative plates and the refrigerant gas, because of the fact that the heat energy is prevented from transferring between the neighboring two regenerative plates 531 in the heat exchanging unit 530.

Figure 25:
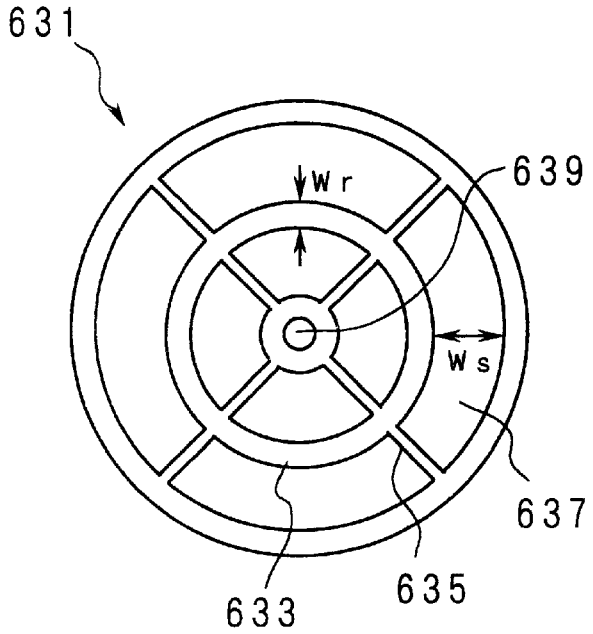
FIGS. 25 and 26 are front views of a pair of regenerative plates adaptable for use in a sixth embodiment of the heat exchanger according to the present invention.
Figure 26:
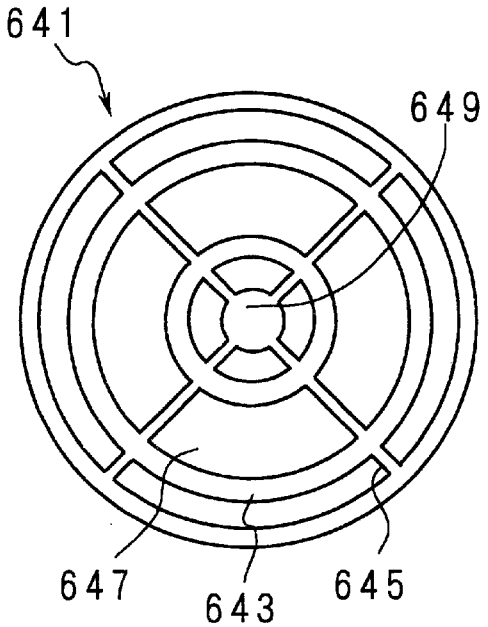
Figure 27:
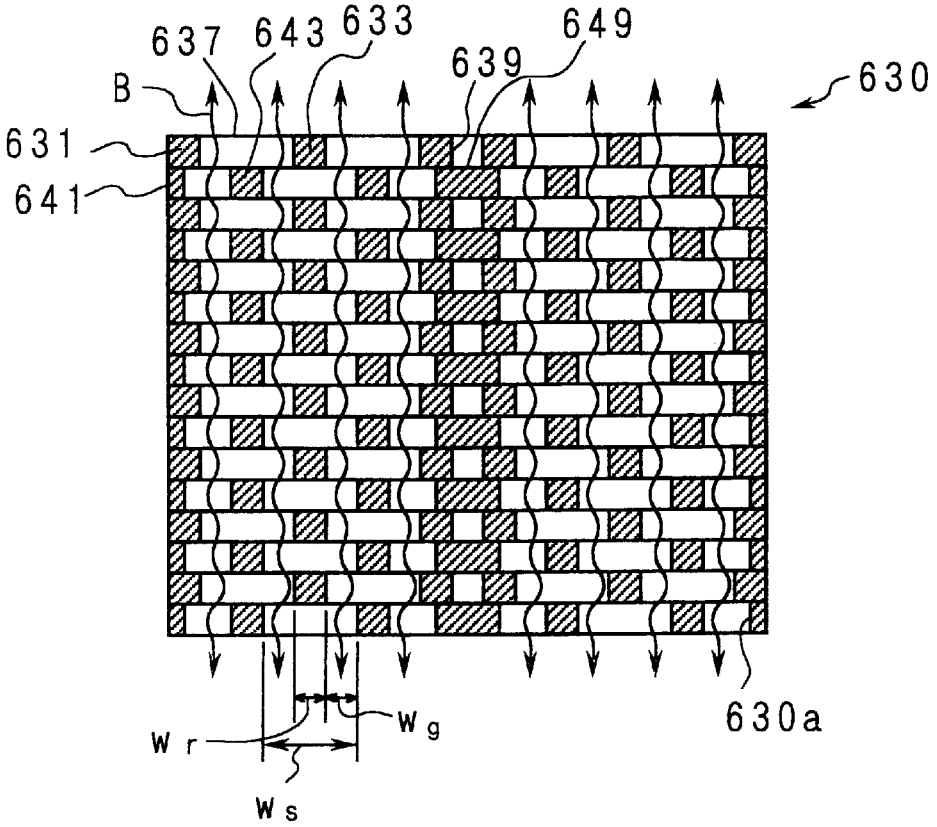
FIG. 27 is a cross-sectional view of a regenerative heat exchanging unit constituted by a plurality of the regenerative plates shown in FIGS. 25 and 26.

Referring now to FIGS. 25 to 27 of the drawings, there is shown a sixth embodiment of the heat exchanger according to the present invention.

In this embodiment, the heat exchanger comprises the same gas casing 111 as that of the fifth embodiment and a heat exchanging unit 630. The heat exchanging unit 630 has a center axis and including first and second groups of regenerative plates 631 and 641. The heat exchanger may comprise two or more groups of regenerative plates. Each of the regenerative plates 631 and 641 has a thickness to have a first flat surface and a second flat surface opposite to the first flat surface. The regenerative plates 631 and 641 are situated by turn in the gas chamber 113 of the gas casing 111, as shown in FIG. 27, in face-to-face relationships with one another to have the first and second flat surfaces substantially perpendicular to the center axis of the heat exchanging unit 630.

The heat exchanging unit 630 is received in the gas chamber 113 of the gas casing 111 with the center axis thereof being in coaxial relationship with the center axis of the gas casing 111. In practice, the total number of the regenerative plates 631 and 641 is 2000. Each of the regenerative plates 631 and 641 is made of a material having a thermal conductivity and a heat capacity. Each of the regenerative plates 631 and 641 has a central point and being shaped in the symmetrical outline form with respect to the central point and smaller in size than the cross-sections of the gas chamber 113 of the gas casing 111.

Each of the regenerative plates 631 and 641 has a plurality of circumferential rib portions 633 and 643 each having a width, which is indicative of the reference symbol "$w_r$" in FIG. 25, and circumferentially extending along the outline of the regenerative plate 631 and 641. In this embodiment, each of the regenerative plates 631 has three circumferential rib portions 633, but in practice a large number of circumferential rib portions 633. Each of the regenerative plates 641 has three circumferential rib portions 643, but in practice a large number of circumferential rib portions 643.

The circumferential rib portions 633 and 643 are arranged in concentric relationship with respect to the central point of the regenerative plate 631 and 641 and radially spaced apart from one another. Each of the regenerative plates 631 and 641 has a plurality of radial rib portions 635 and 645 each having a width narrower than that of each of the circumferential rib portions and radially extending from the central point thereof and angularly spaced apart from one another. The circumferential rib portions 633 and 643 and the radial rib portions 635 and 645 define as a whole a plurality of slits 637 and 647 radially outwardly of the central point of the regenerative plates 631 and 641, respectively, and radially and circumferentially spaced apart from one another.

The circumferential rib portions 633 of the first group of the regenerative plates 631 are arranged at the position of the slits 647 of the second group of the regenerative plates 641. The circumferential rib portions 643 of the second group of the regenerative plates 641 are arranged at the position of the slits 637 of the first group of the regenerative plates 631. Each of the slits 637 and 647 has a width, which is indicative of the reference symbol "$w_s$" in FIG. 25. The width $w_s$ of each of the slits 637 and 647 is larger than the width $w_r$ of the circumferential rib portions 633 and 643 of the regenerative plates 631 and 641. For this reason, the plurality of slits 631 and 641 of the regenerative plates 631 and 641 define a plurality of inner gas flow passageways 630*a* in the heat exchanging unit 630 in substantially perpendicular relationship to the first and second flat surfaces of the regenerative plates 631 and 641 to allow the refrigerant gas to flow therethrough to effect a heat exchange between the regenerative plates 631 and 641 and the refrigerant gas therethrough while the refrigerant gas is passing through the first and second ports 111*a* and 111*b* of the gas casing 111.

In this embodiment, the slits 637 of the first group of regenerative plates 631 overlap with the slits 647 of the second group of regenerative plates 641 to have the gas flow passageways 630*a* meander in the heat exchanging unit 630 when the first and second groups of regenerative plates 631 and 641 are situated by turn in the gas chamber 113 of the gas casing 111 as shown in FIG. 27. The refrigerant gas can be allowed to flow through the gas flow passageways 630*a* along wavy lines represented by double headed arrows "B" in FIG. 27. Each of the inner gas flow passageways 630*a* has an internal diameter, which is indicated by the reference symbol "$w_g$" in FIG. 27. In this embodiment, the width $w_s$ of each of slits 637 and 647 of the regenerative plates 641 and 641 is 0.07 mm, while the width $w_r$ of each of the circumferential rib portions 633 and 643 of the regenerative plates 641 and 641 is 0.03 mm. Accordingly, the internal diameter $w_g$ of each of the inner gas flow passageways 630*a* is 0.02 mm. This means that the internal diameter $w_g$ of each of the inner gas flow passageways 630*a* in the heat exchanging unit 630 is decreased in comparison with the internal diameter of the inner gas flow passageways in another heat exchanging unit which are constructed by a plurality of one kind of regenerative plates.

In this embodiment, the inner gas flow passageways 630*a* meander in the heat exchanging unit 630, thereby increasing an area of the surface of the regenerative plates 631 and 641 which are held in contact with the refrigerant gas passing through the inner gas flow passageways 630*a*. This results in the fact that the heat exchanger thus constructed can effectively perform the heat exchange between the regenerative plates and the refrigerant gas.

As shown in FIGS. 25 and 26, each of the regenerative plates 631 of the first group has a central portion 639 different in shape from the central portion 649 of each of the regenerative plates 641 of the second group. The central portion 639 of the first regenerative plates 631 preferably has a through bore 639. Two groups of regenerative plates 631 and 641 can thus be distinguished from each other with the different central portions 639 and 649.

Figure 28:
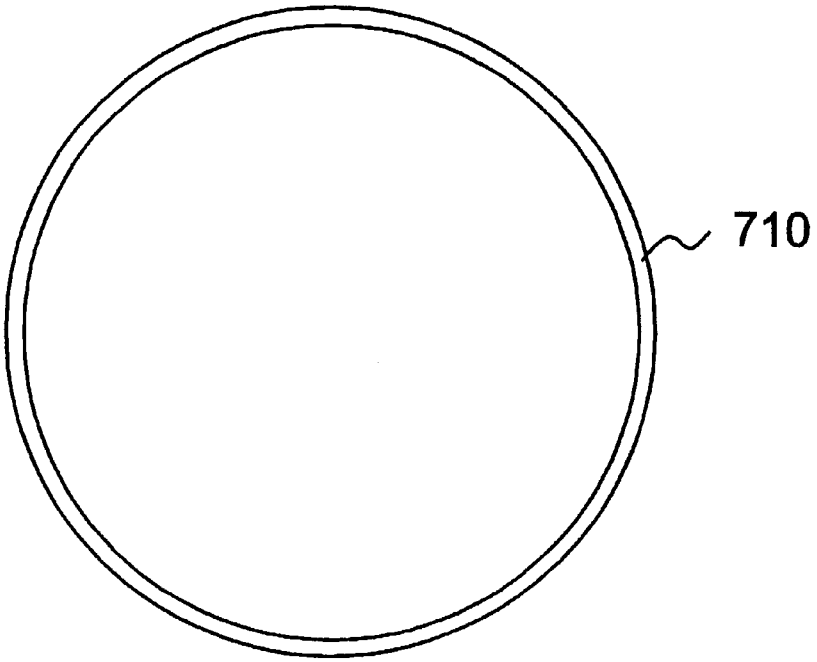
FIG. 28 is a front view of a spacer adaptable for use in a seventh embodiment of the heat exchanger according to the present invention.
Figure 29:
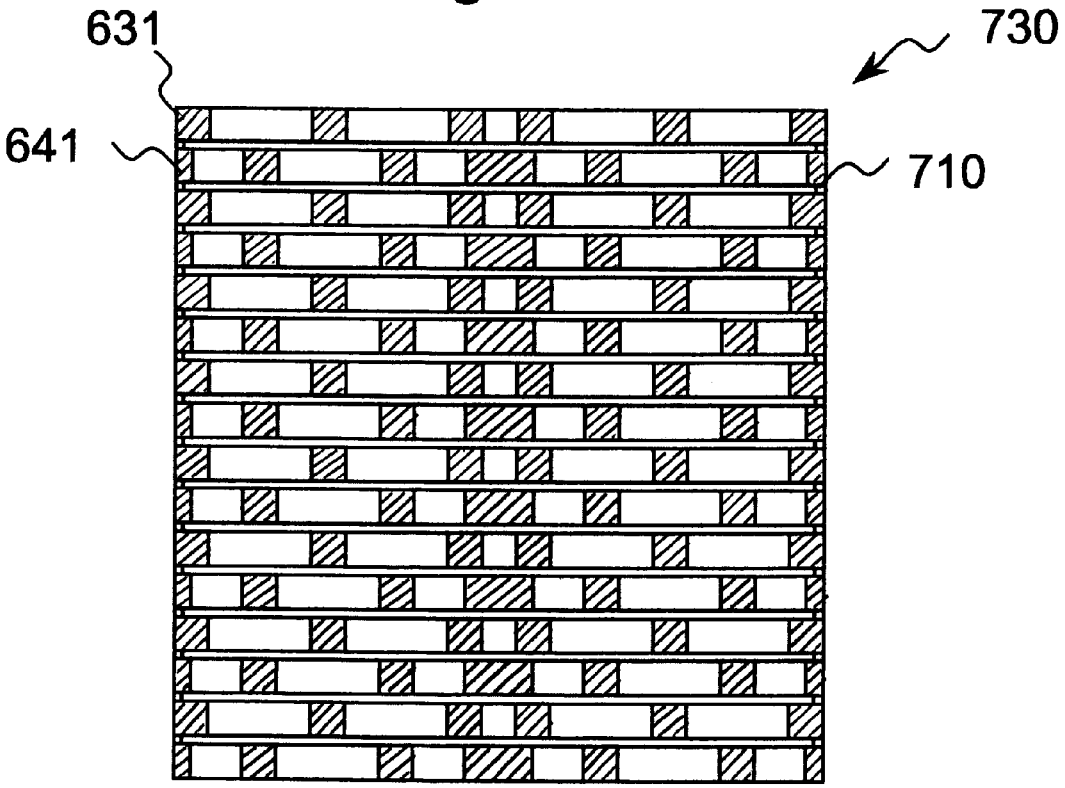
FIG. 29 is a cross-sectional view of a regenerative heat exchanging unit constituted by a plurality of the regenerative plates shown in FIGS. 25 and 26 and a plurality of the spacers shown in FIG. 28.

Referring to FIGS. 28 and 29, there is shown a seventh embodiment of the heat exchanger according to the present invention.

In this embodiment, the heat exchanger comprises the same gas casing 111 as that of the fifth embodiment and a heat exchanging unit 730. The heat exchanging unit 730 has a center axis and including a plurality of regenerative plates 631 and 641 same as those of the sixth embodiment. The heat exchanging unit 730 comprises a plurality of spacers 710, each intervening between the regenerative plates 631 and 641 to have the regenerative plates 631 and 641 situated in face-to-face and thermally insulated relationships with one another in the gas chamber 113 of the gas casing 111 to define spaces each between the neighboring two regenerative plates 631. The spacer 710 is made of a stainless steel and have a ring-shaped form as shown in FIG. 28. The spacer 710 has an outer diameter substantially equal to that of each of regenerative plates 631 and 641 and a thickness of 0.03 mm. The heat exchanging unit 730 thus constructed can more effectively perform the heat exchange between the regenerative plates and the refrigerant gas.

Figure 30:
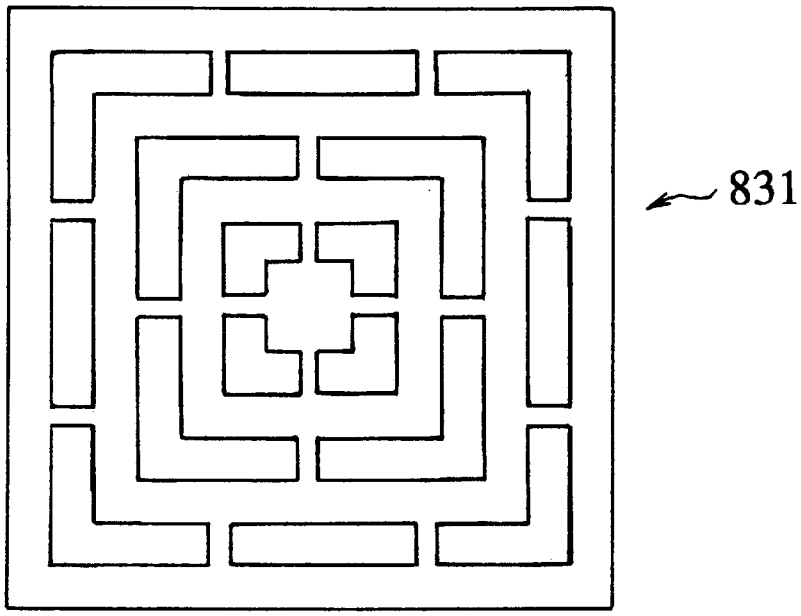
FIG. 30 is a front view of another example of the regenerative plate adaptable for use in the heat exchanger according to the present invention.
Figure 31:
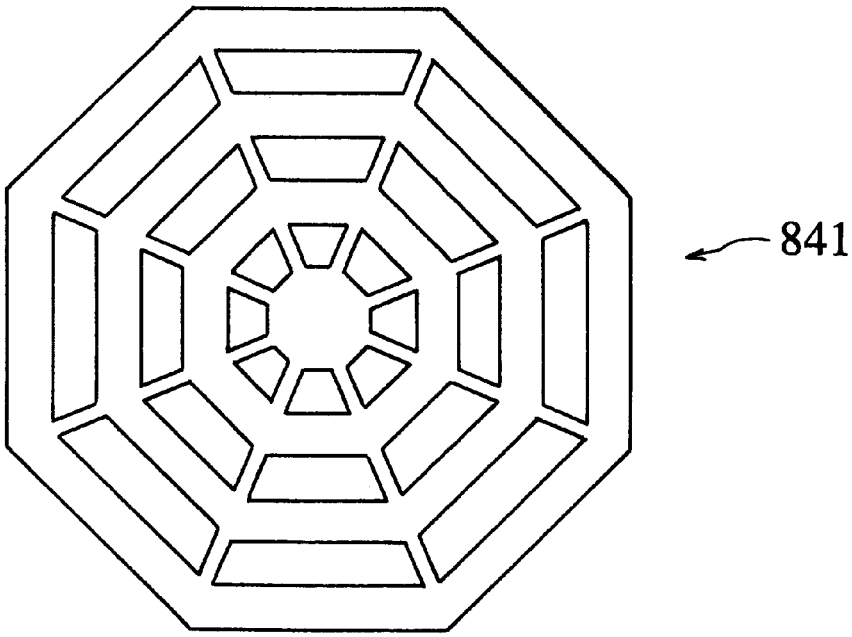
FIG. 31 is a front view of alternative example of the regenerative plate adaptable for use in the heat exchanger according to the present invention.
Figure 32:
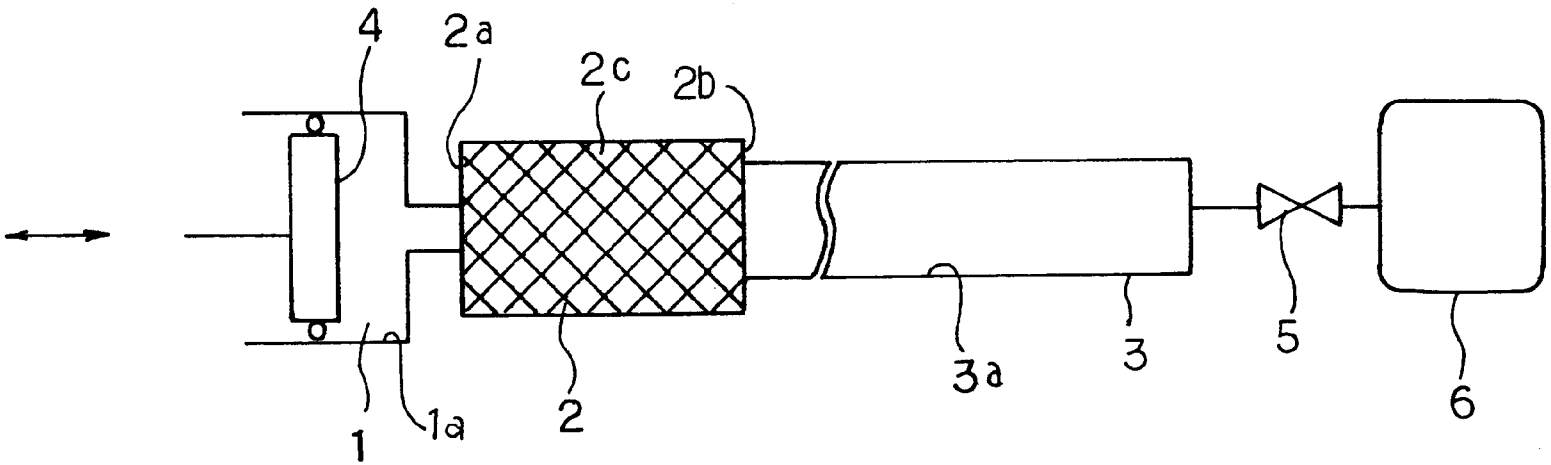
FIG. 32 is a schematic block diagram of a typical pulse-tube refrigerator.
Figure 33:
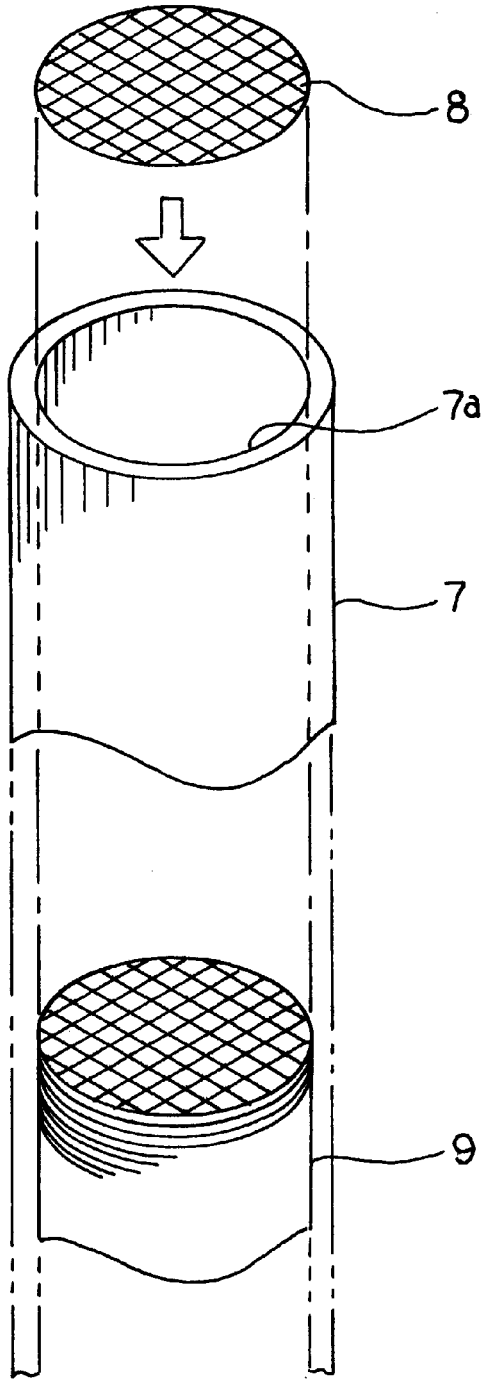
Fig. 33 PRIOR ART
FIG. 33 is a schematic block diagram of a conventional heat exchanger.

Although the regenerative plates in the aforesaid embodiment are shaped in the form of a disc, the regenerative plates of the heat exchanger according to the present invention may be shaped in the other forms, for example, a square (831), a hexagon (841), and so forth, as shown in FIGS. 30 and 31. The gas chamber 113 of the gas casing 111 has cross-sections taken along planes substantially perpendicular to the center axis thereof and uniform in size and shape with each other. Each of the regenerative plates has a central point and is shaped as long as in the symmetrical outline form with respect to the central point and smaller in size than the cross-sections of the gas chamber 113 of the gas casing 111, so that the regenerative plates can be snugly received in the gas chamber 113 of the gas casing 111.

It will be apparent to those skilled in the art and it is contemplated that variations and/or changes in the embodiments illustrated and described herein may be without departure from the present invention. Accordingly, it is intended that the foregoing description is illustrative only, not limiting, and that the true spirit and scope of the present invention will be determined by the appended claims.

What is claimed is:

1. A regenerative heat exchanger comprising:

a hermetically sealed gas casing formed with a gas chamber filled with a refrigerant gas and having a center axis, said gas casing having longitudinal end portions along said center axis and formed with first and second ports having said refrigerant gas passing therethrough, said gas chamber of said gas casing having cross-sections taken along planes substantially perpendicular to said center axis thereof and uniform in size and shape with each other; and a heat exchanging unit having a center axis and a plurality of regenerative plates each having a thickness to have a first flat surface and a second flat surface opposite to said first flat surface, said regenerative plates being situated in face-to-face relationships with one another to have said first and second flat surfaces substantially perpendicular to said center axis of said heat exchanging unit, said heat exchanging unit being received in said gas chamber of the gas casing with said center axis thereof being in coaxial relationship with said center axis of said gas casing, each of said regenerative plates being made of a material having a thermal conductivity and a heat capacity, each of said regenerative plates having a central point and being shaped in the symmetrical outline form with respect to said central point and smaller in size than said cross-sections of said gas chamber of said gas casing, each of said regenerative plates having a plurality of circumferential rib portions each having a width and circumferentially extending along the outline of said regenerative plate, said circumferential rib portions being arranged in concentric relationship with respect to said central point of said regenerative plate and radially spaced apart from one another, each of said regenerative plates having a plurality of radial rib portions each having a width narrower than that of each of said circumferential rib portions and radially extending from said central point thereof and angularly spaced apart from one another, said circumferential rib portions and said radial rib portions defining as a whole a plurality of slits radially outwardly of said central point of said regenerative plates and radially and circumferentially spaced apart from one another, said plurality of slits of said regenerative plates defining a plurality of inner gas flow passageways in said heat exchanging unit in substantially perpendicular relationship to said first and second flat surfaces of said regenerative plates to allow said refrigerant gas to flow therethrough to effect a heat exchange between said regenerative plates and said refrigerant gas therethrough while said refrigerant gas is passing through said first and second ports of said gas casing.

2. The regenerative heat exchanger as set forth in claim 1, in which said heat exchanging unit includes first and second groups of said regenerative plates, said circumferential rib portions of said first group of said regenerative plates being arranged at the position of said slits of said second group of said regenerative plates, said circumferential rib portions of said second group of said regenerative plates being arranged at the position of said slits of said first group of said regenerative plates, so that said slits of said first group of regenerative plates overlap with said slits of said second group of regenerative plates to have said gas flow passageways meander in said heat exchanging unit when said first and second groups of regenerative plates are situated by turn in said gas chamber of said gas casing.

3. The regenerative heat exchanger as set forth in claim 2, in which each of said regenerative plates of said first group has a central portion different in shape from that of each of said regenerative plates of said second group.

4. The regenerative heat exchanger as set forth in claim 2, in which one of said central portions of said first and second regenerative plates has a through bore.

* * * * *